US011443670B2

(12) United States Patent
Kim et al.

(10) Patent No.: US 11,443,670 B2
(45) Date of Patent: Sep. 13, 2022

(54) DISPLAY DEVICE, CONTROLLER, DRIVING CIRCUIT, AND DRIVING METHOD CAPABLE OF IMPROVING MOTION PICTURE RESPONSE TIME

(71) Applicant: LG DISPLAY CO., LTD., Seoul (KR)

(72) Inventors: Hyuckjun Kim, Gyeonggi-do (KR); SeungTae Kim, Gyeonggi-do (KR); Yumin Hong, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/877,852

(22) Filed: May 19, 2020

(65) Prior Publication Data

US 2020/0380906 A1 Dec. 3, 2020

(30) Foreign Application Priority Data

May 31, 2019 (KR) ..... 10-2019-0064781

(51) Int. Cl.
*G09G 3/20* (2006.01)

(52) U.S. Cl.
CPC ..... *G09G 3/20* (2013.01); *G09G 2310/062* (2013.01); *G09G 2320/0252* (2013.01); *G09G 2320/0257* (2013.01); *G09G 2320/10* (2013.01)

(58) Field of Classification Search
CPC ..... G09G 3/30; G09G 3/32; G09G 3/3208; G09G 3/3216; G09G 3/3225; G09G 3/3233; G09G 3/3241; G09G 3/325; G09G 3/3258; G09G 2310/06; G09G 2310/061; G09G 2310/062; G09G 2310/063
USPC ..... 345/76–83, 87–104
See application file for complete search history.

(56) References Cited

U.S. PATENT DOCUMENTS

2003/0058200 A1* 3/2003 Numao ..... G09G 3/3258 345/76
2009/0284515 A1* 11/2009 Tsuge ..... G09G 3/3233 345/211
2013/0002736 A1* 1/2013 Park ..... G09G 3/3225 345/691
2015/0379940 A1* 12/2015 Kishi ..... G09G 3/3291 345/690
2016/0005384 A1* 1/2016 Yoon ..... G09G 3/3233 345/213
2016/0117991 A1* 4/2016 Ha ..... G09G 3/3233 345/78
2017/0031485 A1* 2/2017 Kim ..... G09G 3/3233
2018/0061320 A1* 3/2018 Kim ..... G09G 3/3291
2018/0182287 A1* 6/2018 Park ..... H01L 51/5206
2020/0160781 A1* 5/2020 Park ..... G09G 3/3275
2021/0005145 A1* 1/2021 Lee ..... G09G 3/3233
2021/0193028 A1* 6/2021 Choi ..... G09G 3/32

* cited by examiner

*Primary Examiner* — Alexander Eisen
*Assistant Examiner* — Nelson Lam
(74) *Attorney, Agent, or Firm* — Birch, Stewart, Kolasch & Birch, LLP

(57) ABSTRACT

Embodiment of the present disclosure relate to a display device, a controller, a driving circuit, and a driving method capable of easily improving the motion picture response time through a multi-scanning operation of switching devices.

15 Claims, 18 Drawing Sheets

DISPLAY DEVICE, CONTROLLER, DRIVING CIRCUIT, AND DRIVING METHOD CAPABLE OF IMPROVING MOTION PICTURE RESPONSE TIME

CROSS REFERENCE TO RELATED APPLICATION

This application claims the priority benefit of Korean Patent Application No. 10-2019-0064781, filed in the Republic of Korea on May 31, 2019, the entire contents of which is hereby expressly incorporated by reference for all purposes as if fully set forth herein into the present application.

BACKGROUND OF THE INVENTION

1. Field of the Invention

Embodiments of the present disclosure relate to a display device, a controller, a driving circuit, and a driving method.

2. Description of the Related Art

The development of an information society has brought an increasing demand for various types of display devices for displaying images, and in recent years, various display devices such as liquid crystal displays, plasma display devices, and organic light-emitting display devices have been utilized.

When displaying motion pictures, existing display devices can exhibit a phenomenon in which the afterimage of the previous frame is displayed on the subsequent frame due to a long motion picture response time, which may degrade the image quality.

SUMMARY OF THE INVENTION

Embodiments of the present disclosure can provide a display device, a controller, a driving circuit, and a driving method capable of easily improving the motion picture response time.

In addition, embodiments of the present disclosure can provide a display device, a controller, and a driving circuit having a new subpixel structure capable of improving the motion picture response time, and a driving method thereof.

In addition, embodiments of the present disclosure can provide a display device, a controller, a driving circuit, and a driving method capable of easily improving the motion picture response time through a multi-scanning operation of switching devices.

In addition, embodiments of the present disclosure can provide a display device, a controller, a driving circuit, and a driving method capable of improving the motion picture response time by intermittently displaying a fake image (e.g., a black images) different from a real image while the real image is being displayed.

In addition, embodiments of the present disclosure can provide a display device, a controller, a driving circuit, and a driving method capable of easily improving the motion picture response time by controlling a bias state in a subpixel through on/off control of switching devices without supplying fake image data, thereby intermittently displaying a fake image (e.g., a black images) different from a real image while the real image is being displayed.

In an aspect, embodiments of the present disclosure can provide a display device including a display panel including a plurality of data lines, a plurality of first gate lines, a plurality of second gate lines, and a plurality of reference lines arranged thereon, and further including a plurality of subpixels including an emission device, a driving transistor, and a storage capacitor; a data driving circuit configured to be electrically connected to the plurality of data lines; and a gate driving circuit configured to be electrically connected to the plurality of first gate lines and the plurality of second gate lines.

The plurality of subpixels can constitute a plurality of subpixel lines, and the plurality of subpixel lines can correspond to the plurality of first gate lines.

The display panel can have a plurality of first transistors controlled by first gate signals sequentially supplied through the plurality of first gate lines and a plurality of second transistors controlled by second gate signals sequentially supplied through the plurality of second gate lines, which are arranged thereon.

The plurality of first transistors can be included in the plurality of subpixels, respectively, and the plurality of second transistors can be included in the plurality of subpixels, respectively, In each of the plurality of subpixels, the first transistor can be controlled by a first gate signal supplied through the first gate line, and can electrically connect a first node of the driving transistor to the reference line. The first node of the driving transistor can be a gate node of the driving transistor. The second transistor can be controlled by a second gate signal supplied through the second gate line, and can electrically connect a second node of the driving transistor to the data line. The second node of the driving transistor can be a source node or a drain node of the driving transistor.

The gate driving circuit can sequentially drive each of the plurality of first gate lines twice during one frame time.

As the plurality of first gate lines are primarily driven in sequence, the display panel can display a real image. As the plurality of first gate lines are secondarily driven in sequence, the display panel can display a fake image different from the real image.

The fake image can be a black image or a low-grayscale image.

During the one frame time, first driving for sequentially driving the plurality of subpixel lines so as to display the real image on the display panel and a second driving for sequentially driving the plurality of subpixel lines so as to display the fake image on the display panel can be performed.

The first transistor can be turned on, and can then be turned off and the second transistor can be turned on, and can then be turned off in each subpixel included in the subpixel line on which the first driving is performed.

The first transistor can be turned on and the second transistor can be maintained to be turned off in each subpixel included in the subpixel line on which the second driving is performed.

A voltage of the first node of the driving transistor can be higher than a voltage of the second node of the driving transistor in each subpixel included in the subpixel line on which the first driving is performed.

A voltage of the first node of the driving transistor can be lower than a voltage of the second node of the driving transistor in each subpixel included in the subpixel line on which the second driving is performed.

A data program and emission can be sequentially performed in each subpixel included in the subpixel line on which the first driving is performed.

The first transistor can be primarily turned on so that a first reference voltage is applied to the first node of the driving transistor and the second transistor can be turned on so that an image data voltage is applied to the second node of the driving transistor while the data program is being performed in each subpixel included in the subpixel line on which the first driving is performed.

The first transistor and the second transistor can be turned off, the voltages of the first node and the second node of the driving transistor can be boosted, and then the emission device can emit light while the emission is being performed in each subpixel included in the subpixel line on which the first driving is performed.

In each subpixel included in the subpixel line on which the second driving is performed, the first transistor can be secondarily turned on so that a second reference voltage is applied to the first node of the driving transistor, the second transistor can remain in a turn-off state, and the emission device can stop emitting light.

The first reference voltage can be higher than the image data voltage applied to the second node of the driving transistor.

The second reference voltage can be lower than the boosted voltage of the second node of the driving transistor when emission is performed.

While a first subpixel line of the plurality of subpixel lines performs the data program during the first driving, a subpixel line different from the first subpixel line can perform the second driving.

While a second subpixel line of the plurality of subpixel lines performs the second driving, a subpixel line different from the second subpixel line can perform the data program during the first driving.

While the first reference voltage is applied to a plurality of subpixels included in a first subpixel line of the plurality of subpixel lines, the second reference voltage can be applied to a plurality of subpixels included in a subpixel line different from the first subpixel line.

While the second reference voltage is applied to a plurality of subpixels included in a second subpixel line of the plurality of subpixel lines, the first reference voltage can be applied to a plurality of subpixels included in a subpixel line different from the second subpixel line.

The first reference voltage and the second reference voltage can be the same.

The second reference voltage can be lower than the first reference voltage.

The plurality of reference lines can be arranged in parallel to the plurality of data lines, and each reference line can be arranged for every one or more subpixel columns. A reference voltage supplied to the plurality of reference lines can be variable in a data driving circuit or a printed circuit board.

The plurality of reference lines can be arranged in parallel to the plurality of first or second gate lines, and all of the plurality of reference lines can be electrically connected to one outer wire arranged in a non-active area. A reference voltage supplied to the one outer wire can be variable in the data driving circuit or the printed circuit board.

The plurality of reference lines can be arranged in parallel to the plurality of first or second gate lines, and the plurality of reference lines can be grouped into two or more, and can be electrically connected to two or more outer wires arranged in a non-active area. A reference voltage supplied to each of the two or more outer wires can be variable in the data driving circuit or the printed circuit board.

The capacitance of a capacitor component of the emission device can be greater than that of the storage capacitor.

The data driving circuit can include K digital-to-analog converters corresponding to K data lines, and one analog-to-digital converter corresponding to K data lines, where K can be a positive number, e.g., positive integer. One of the K data lines can be electrically connected to one of the K digital-to-analog converters, or can be connected to the analog-to-digital converter The data driving circuit can include K digital-to-analog converters and K analog-to-digital converters corresponding to K data lines.

One of the K data lines can be electrically connected to one of the K digital-to-analog converters, or can be connected to one of the K analog-to-digital converters.

In another aspect, embodiments of the present disclosure can provide a driving method of a display device, wherein the display device includes a display panel including a plurality of data lines, a plurality of first gate lines, a plurality of second gate lines, and a plurality of reference lines arranged thereon, the display panel further including a plurality of subpixels; a data driving circuit configured to drive the plurality of data lines; and a gate driving circuit configured to drive the plurality of first gate lines and the plurality of second gate lines.

The driving method can include displaying a real image on the display panel by sequentially scanning the plurality of first gate lines and the plurality of second gate lines during a first time in one frame time; and displaying a fake image different from the real image on the display panel by sequentially scanning the plurality of first gate lines during a second time different from the first time in the one frame time.

Each of the plurality of subpixels can include an emission device; a driving transistor configured to drive the emission device; a first transistor controlled by a first gate signal supplied through a corresponding first gate line of the plurality of first gate lines, and configured to electrically connect a first node of the driving transistor to the reference line; a second transistor controlled by a second gate signal supplied through a corresponding second gate line of the plurality of second gate lines, and configured to electrically connect a second node of the driving transistor to the data line; and a storage capacitor electrically connected between the first node and the second node of the driving transistor.

The first node of the driving transistor is a gate node of the driving transistor, and the second node of the driving transistor is a source node or a drain node of the driving transistor.

A voltage of the first node of the driving transistor can be higher than a voltage of the second node of the driving transistor during the first time. A voltage of the first node of the driving transistor can be lower than a voltage of the second node of the driving transistor during the second time.

In another aspect, embodiments of the present disclosure can provide a controller for a display device. wherein the display device includes a display panel having a plurality of data lines, a plurality of first gate lines, a plurality of second gate lines, a plurality of reference lines, and a plurality of subpixels; a data driving circuit configured to drive the plurality of data lines; and a gate driving circuit configured to drive the plurality of first gate lines and the plurality of second gate lines.

The controller can include a timing controller configured to control the gate driving circuit and the data driving circuit; and an image data supplier configured to output image data.

The timing controller can perform control so that the gate driving circuit sequentially drives the plurality of first gate lines and the plurality of second gate lines during a first time in one frame time.

The timing controller can perform control so that the gate driving circuit sequentially drives the plurality of first gate lines during a second time different from the first time in one frame time.

The timing controller can perform control so that the data driving circuit outputs an image data voltage corresponding to the image data to the plurality of data lines when the gate driving circuit sequentially scans the plurality of first gate lines and the plurality of second gate lines during the first time.

A real image can be displayed on the display panel during the first time, and a fake image different from the real image can be displayed on the display panel during the second time.

In another aspect, embodiments of the present disclosure can provide a gate driving circuit including a first gate driving circuit configured to drive the plurality of first gate lines; and a second gate driving circuit configured to drive the plurality of second gate lines.

The first gate driving circuit can sequentially drive the plurality of first gate lines during a first time in one frame time, and can sequentially drive the plurality of first gate lines during a second time different from the first time in one frame time.

The second gate driving circuit can sequentially drive the plurality of second gate lines, when the plurality of first gate lines are sequentially driven, during the first time.

An image data voltage can be applied to the plurality of data lines, when the second gate driving circuit sequentially drives the plurality of second gate lines, during the first time.

A real image can be displayed on the display panel during the first time, and a fake image different from the real image can be displayed on the display panel during the second time.

According to embodiments of the present disclosure, it is possible to improve the image quality through driving for easily improving the motion picture response time.

In addition, according to embodiments of the present disclosure, it is possible to provide a new subpixel structure capable of improving the motion picture response time.

In addition, according to embodiments of the present disclosure, it is possible to easily improve the motion picture response time through a multi-scanning operation of switching devices.

In addition, according to embodiments of the present disclosure, it is possible to improve the motion picture response time by intermittently displaying a fake image (e.g., a black images) different from a real image while the real image is being displayed.

Further, according to embodiments of the present disclosure, it is possible to easily improve the motion picture response time by controlling a bias state in a subpixel through on/off control of switching devices without supplying fake image data, thereby intermittently displaying a fake image (e.g., a black images) different from a real image while the real image is being displayed.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION OF THE EMBODIMENTS

Figure 1:
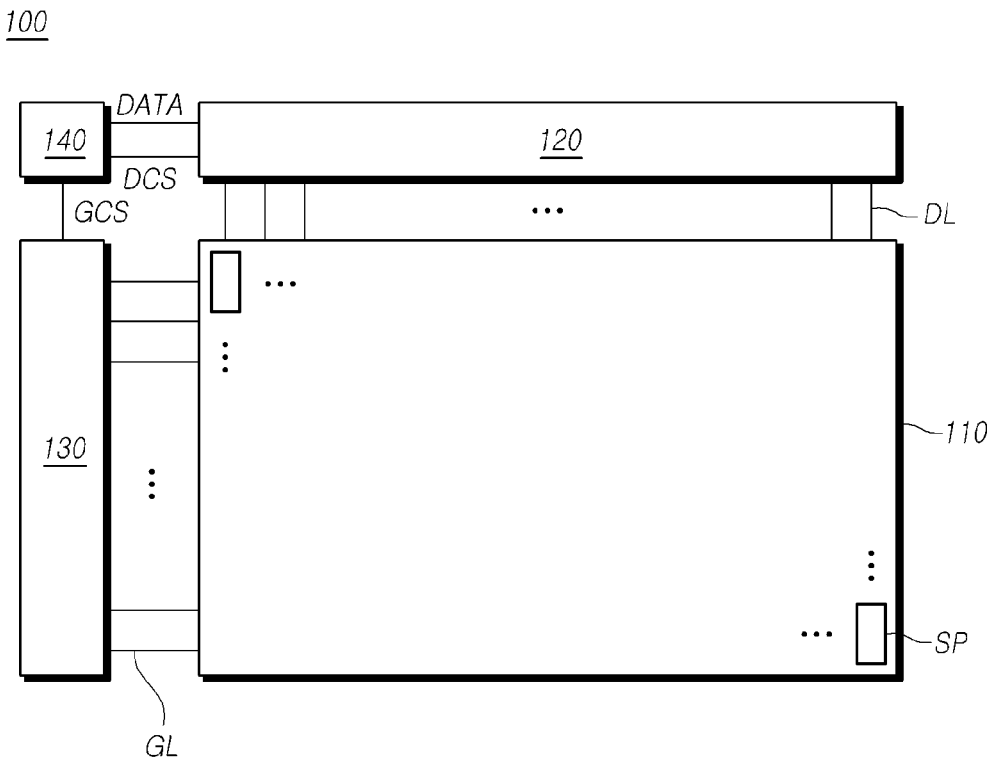
FIG. 1 is a diagram illustrating the system configuration of a display device according to embodiments of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description can make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" can be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element can be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms can be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that can be caused by various factors (e.g., process factors, internal or external impact, noise, etc.) even when a relevant description is not specified. Further, the term "may" fully encompasses all the meanings of the term "can."

FIG. 1 is a diagram illustrating the system configuration of a display device 100 according to embodiments of the present disclosure. All the components of the display device according to all embodiments of the present disclosure are operatively coupled and configured.

Referring to FIG. 1, the display device 100 according to the present embodiments can include a display panel 110 having a plurality of data lines DL, a plurality of gate lines GL, and a plurality of subpixels SP, which are arranged thereon; a data driving circuit 120 for driving the plurality of data lines DL; a gate driving circuit 130 for driving the plurality of gate lines GL; a controller 140 for controlling the data driving circuit 120 and the gate driving circuit 130; and the like.

The plurality of data lines DL and the plurality of gate lines GL can be arranged to intersect each other in the display panel 110. For example, the plurality of data lines DL can be arranged in a row or column, and the plurality of gate lines GL can be arranged in a column or row. Hereinafter, for the convenience of description, it is assumed that the plurality of data lines DL are arranged in a row, and the plurality of gate lines GL are arranged in a column.

The controller 140 supplies various control signals DCS and GCS for the driving operation of the data driving circuit 120 and the gate driving circuit 130, thereby controlling the data driving circuit 120 and the gate driving circuit 130.

The controller 140 starts scanning according to the timing implemented in each frame, converts input image data input from the outside in conformity with the data signal format used by the data driving circuit 120, outputs the converted image data DATA, and controls data driving at an appropriate time according to the scanning.

The aforementioned controller 140 receives various timing signals including a vertical synchronization signal Vsync, a horizontal synchronization signal Hsync, an input data enable (DE) signal, a clock signal CLK, or the like, as well as the input image data, from the outside (e.g., a host system).

The controller 140 converts the input image data input from the outside in conformity with the data signal format used in the data driving circuit 120 and outputs the converted image data DATA, and in order to control the data driving circuit 120 and the gate driving circuit 130, the controller 140 further receives timing signals such as a vertical synchronization signal Vsync, a horizontal synchronization signal Hsync, an input DE signal, a clock signal, or the like, produces various control signals, and outputs the same to the data driving circuit 120 and the gate driving circuit 130.

For example, in order to control the gate driving circuit 130, the controller 140 outputs various gate control signals GCS including a gate start pulse (GSP), a gate shift clock (GSC), a gate output enable signal (GOE), or the like.

In this case, the gate start pulse (GSP) controls operation start timing of one or more gate driver integrated circuits constituting the gate driving circuit 130. The gate shift clock (GSC), which is a clock signal commonly input to one or more gate driver integrated circuits, controls shift timing of a scan signal (gate pulse). The gate output enable signal (GOE) specifies timing information on one or more gate driver integrated circuits.

In addition, in order to control the data driving circuit 120, the controller 140 outputs various data control signals DCS including a source start pulse (SSP), a source sampling clock (SSC), source output enable signal (SOE), or the like.

In this case, the source start pulse (SSP) controls data sampling start timing of one or more source driver integrated circuits constituting the data driving circuit 120. The source sampling clock (SSC) is a clock signal for controlling timing of sampling data in the respective source driver integrated circuits. The source output enable signal (SOE) controls output timing of the data driving circuit 120.

The controller 140 can be a timing controller used in the normal display technology, or can be a control device capable of further performing other control functions, including the timing controller.

The controller 140 can be implemented as a separate component from the data driving circuit 120, or can be integrated with the data driving circuit 120 into an integrated circuit.

The data driving circuit 120 receives image data DATA from the controller 140 and supplies a data voltage to a plurality of data lines DL, thereby driving the plurality of data lines DL. Here, the data driving circuit 120 can also be referred to as a "source driving circuit".

The data driving circuit 120 can be implemented by including at least one source driver integrated circuit (SDIC).

Each source driver integrated circuit (SDIC) can include a shift register, a latch circuit, a digital-to-analog converter (DAC), an output buffer, or the like.

Each source driver integrated circuit (SDIC), in some cases, can further include an analog-to-digital converter (ADC).

Each source driver integrated circuit (SDIC) can be connected to a bonding pad of the display panel 110 by a tape automated bonding (TAB) method or a chip-on-glass (COG) method, or can be directly arranged on the display panel 110, and in some cases, the source driver integrated circuit (SDIC) can be integrated and arranged on the display panel 110. In addition, each source driver integrated circuit (SDIC) can be implemented by a chip-on-film (COF) method in which an element is mounted on a film connected to the display panel 110.

The gate driving circuit 130 sequentially drives a plurality of gate lines GL by sequentially supplying scan signals to the plurality of gate lines GL. Here, the gate driving circuit 130 can also be referred to as a "scan driving circuit".

The gate driving circuit 130 can be implemented by including at least one gate driver integrated circuit (GDIC).

Each gate driver integrated circuit (GDIC) can include a shift register, a level shifter, or the like.

Each gate driver integrated circuit (GDIC) can be connected to a bonding pad of the display panel 110 by a tape automated bonding (TAB) method or a chip-on-glass (COG) method, or can be implemented as a gate-in-panel (GIP) type to then be directly arranged on the display panel 110, and in some cases, the gate driver integrated circuit (GDIC) can be integrated and arranged on the display panel 110. In addition, each gate driver integrated circuit (GDIC) can be implemented by a chip-on-film (COF) method in which an element is mounted on a film connected to the display panel 110.

The gate driving circuit 130 sequentially supplies scan signals of an on-voltage or an off-voltage to the plurality of gate lines GL under the control of the controller 140.

When a specific gate line is opened by the gate driving circuit 130, the data driving circuit 120 converts image data DATA received from the controller 140 into an analog data voltage and supplies the same to the plurality of data lines DL.

The data driving circuit 120 can be positioned only at one side (e.g., the upper side or the lower side) of the display panel 110, or in some cases, can be positioned at both sides of the display panel 110 (e.g., the upper side and the lower side) depending on a driving method, a panel design method, or the like.

The gate driving circuit 130 can be positioned only at one side (e.g., the left side or the right side) of the display panel 110, or in some cases, can be positioned at both sides of the display panel 110 (e.g., the left side and the right side) depending on a driving method, a panel design method, or the like.

For example, the display device 100 according to the present embodiments can be an organic light-emitting display device, a liquid crystal display device, a plasma display device, or the like.

In the case where the display device 100 according to the present embodiments is a liquid crystal display device, each subpixel SP of the display panel 110 can include a pixel electrode, a transistor for transmitting a data voltage to the pixel electrode, and the like, and the display panel 110 can have a common electrode to which a common voltage is applied so as to form an electric field with a pixel voltage (data voltage) in the pixel electrode of each subpixel SP.

In the case where the display device 100 according to the present embodiments is an organic light-emitting display device or the like, each of the subpixels SP arranged in the display panel 110 can include an emission device, such as an organic light-emitting diode (OLED) that emits light on its own or the like, and a circuit device such as a driving transistor for controlling the emission device.

The type of circuit device constituting each subpixel SP and the number thereof can be variously determined according to provided functions, design methods, or the like.

Figure 2:
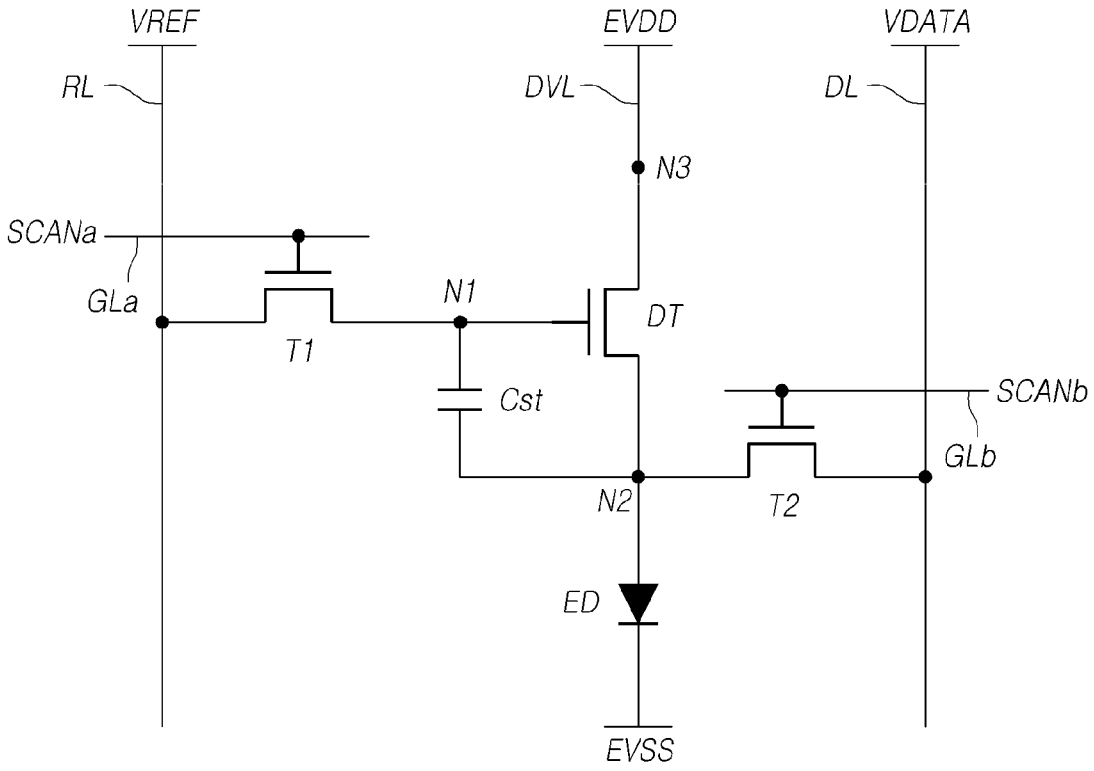
FIG. 2 is an equivalent circuit diagram of a subpixel in a display device according to embodiments of the present disclosure.

FIG. 2 is an example of an equivalent circuit diagram of a subpixel SP in the display device 100 according to embodiments of the present disclosure.

Referring to FIG. 2, each subpixel SP can include an emission device ED, a driving transistor DT, a first transistor T1, a second transistor T2, and a storage capacitor Cst.

The emission device ED can include a first electrode (e.g., an anode electrode) and a second electrode (e.g., a cathode electrode), and can further include an emission layer positioned between the first electrode and the second electrode. For example, the emission device ED can include an organic light-emitting diode (OLED), a light-emitting diode (LED), or the like.

The first electrode of the emission device ED is electrically connected to a second node N2 of the driving transistor DT. A ground voltage EVSS is applied to the second electrode of the emission device ED.

The emission device ED, in terms of a structure, corresponds to a kind of capacitor and has capacitance.

The driving transistor DT can supply a driving current to the emission device ED, thereby driving the same. The driving transistor DT can include a first node N1, a second node N2, and a third node N3.

The first node N1 of the driving transistor DT can be electrically connected to a source node or a drain node of the first transistor T1, and can also be electrically connected to one of two plates included in the storage capacitor Cst.

The second node N2 of the driving transistor DT can be electrically connected to the source node or the drain node of the second transistor T1, can be electrically connected to the remaining one of the two plates included in the storage capacitor Cst, and can also be electrically connected to the first electrode of the emission device ED.

The third node N3 of the driving transistor DT can be electrically connected to a driving line DVL for supplying a driving voltage EVDD.

In the driving transistor DT, the first node N1 can be a gate node, the second node N2 can be a source node or a drain node, and the third node N3 can be a drain node or a source node.

The first transistor T1 is a transistor for electrically connecting the first node N1 of the driving transistor DT to a reference line RL.

The first transistor T1 can be controlled to be turned on/off by a first gate signal SCANa supplied through a corresponding first gate line GLa among a plurality of first gate lines GLa.

The second transistor T2 can be a transistor for electrically connecting the second node N2 of the driving transistor DT to the data line DL.

The second transistor T2 can be controlled to be turned on/off by a second gate signal supplied through a corresponding second gate line GLb among a plurality of second gate lines GLb.

The storage capacitor Cst can be electrically connected between the first node N1 and the second node N2 of the driving transistor DT. For example, the storage capacitor Cst includes two plates that can be electrically connected to the first node N1 and the second node N2 of the driving transistor DT, respectively.

The storage capacitor Cst can be an external capacitor intentionally designed to be provided outside the driving transistor DT, instead of a parasitic capacitor (e.g., Cgs or Cgd) that is an internal capacitor provided between the first node N1 and the second node N2 of the driving transistor DT.

Each of the driving transistor DT, the first transistor T1, and the second transistor T2 included in each subpixel SP can be an n-type transistor or a p-type transistor, and can be implemented in various types of transistors.

As described above, the first gate signal SCANa for controlling the first transistor T1 to be turned on/off and a second gate signal SCANb for controlling the second transistor T2 to be turned on/off are required.

Accordingly, the plurality of gate lines GL arranged on the display panel 110 can include a plurality of first gate lines GLa and a plurality of second gate lines GLb. The gate driving circuit 130 can include a first gate driving circuit for driving the plurality of first gate lines GLa and a second gate driving circuit for driving the plurality of second gate lines GLb.

Figure 3:
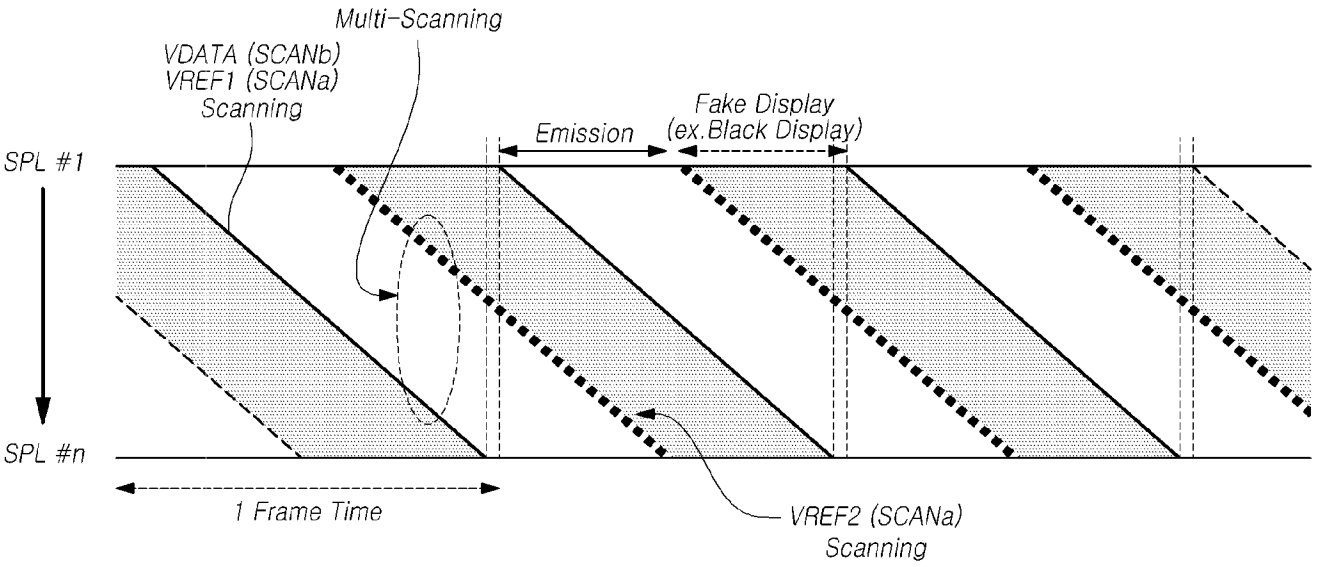
FIG. 3 is a diagram illustrating a frame according to driving for improving the motion picture response time of a display device according to embodiments of the present disclosure.
Figure 4:
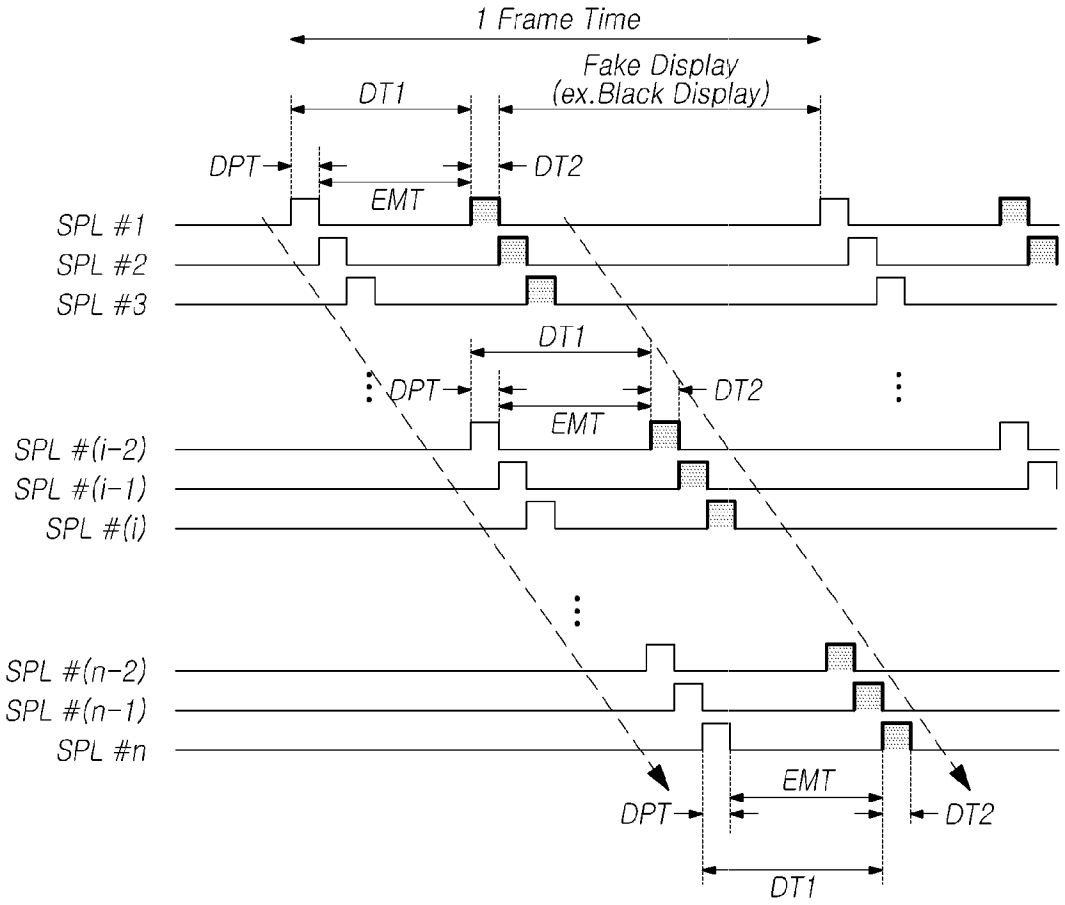
FIG. 4 is a driving timing diagram of multi-scanning for a plurality of first gate lines in a display device according to embodiments of the present disclosure.
Figure 5:
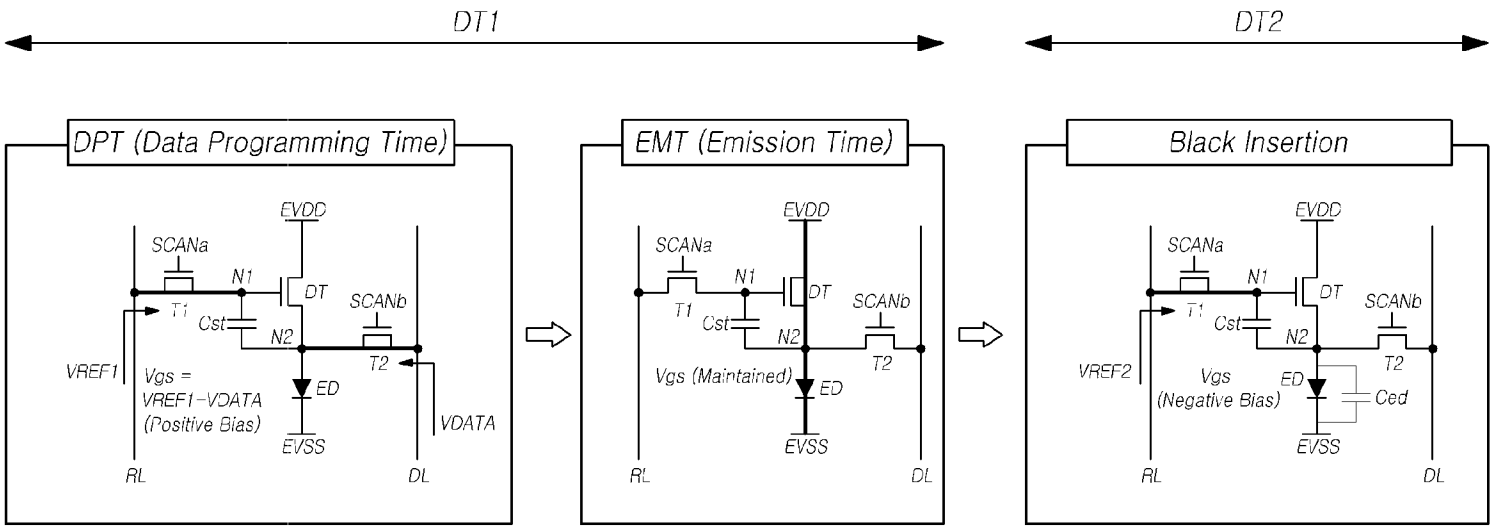
FIG. 5 is a diagram illustrating the driving state of one subpixel in driving for improving the motion picture response time of a display device according to embodiments of the present disclosure.

FIG. 3 is a diagram illustrating a frame according to driving for improving the motion picture response time (MPRT) of a display device 100 according to embodiments of the present disclosure; FIG. 4 is a driving timing diagram of multi-scanning for a plurality of first gate lines GLa in a display device 100 according to embodiments of the present disclosure; and FIG. 5 is a diagram illustrating the driving state of one subpixel SP in driving for improving a motion picture response time of a display device 100 according to embodiments of the present disclosure.

Hereinafter, for the convenience of description, it is assumed that the first node N1 of the driving transistor DT is a gate node, the second node N2 of the driving transistor DT is a source node of the driving transistor DT, and the third node N3 is a drain node. Accordingly, the voltage of the first node N1 of the driving transistor DT can also be referred to as a "gate voltage Vg", and the voltage of the second node N2 of the driving transistor DT can also be referred to as a "source voltage Vs".

The display device 100 according to the embodiments of the present disclosure can include a display panel 110 including a plurality of data lines DL, a plurality of first gate lines GLa, a plurality of second gate lines GLb, and a plurality of reference lines RL, which are arranged thereon, and including a plurality of subpixels SP including an emission device ED, a driving transistor DT, a storage capacitor Cst, and the like; and a data driving circuit 120 for driving the plurality of data lines DL; and a gate driving circuit 130 for driving the plurality of first gate lines GLa and the plurality of second gate lines GLb.

Referring to FIGS. 3 and 4, a plurality of subpixels SP can be arranged in a matrix form. The plurality of subpixels SP can constitute a plurality of subpixel lines SPL #1 to SPL #n (n is a natural number of 2 or more). The plurality of subpixel lines SPL #1 to SPL #n can also be referred to as a plurality of "subpixel rows".

The plurality of subpixel lines SPL #1 to SPL #n can correspond to a plurality of first gate lines GLa. The plurality of subpixel lines SPL #1 to SPL #n can correspond to a plurality of second gate lines GLb.

Referring to FIGS. 3 and 4, the gate driving circuit 130 can perform multi-scanning on the plurality of first gate lines GLa. To this end, the gate driving circuit 130 can sequentially drive respective ones of the plurality of first gate lines GLa twice during one frame time. For example, the gate driving circuit 130 can sequentially supply a first gate signal SCANa to the respective ones of the plurality of first gate lines GLa twice during one frame time.

The gate driving circuit 130 can perform single-scanning on the plurality of second gate lines GLb. To this end, the gate driving circuit 130 can sequentially drive respective ones of the plurality of second gate lines GLb only once during one frame time. For example, the gate driving circuit 130 can sequentially supply a second gate signal SCANb to the respective ones of the plurality of second gate lines GLb once during one frame time.

Referring to FIGS. 3 and 4, during a primary scanning of the multi-scanning on the plurality of first gate lines GLa, an image data voltage VDATA and a reference voltage VREF are sequentially supplied to the plurality of subpixel lines SPL #1 to SPL #n (primary supply). In other words, reference voltages VREF can be sequentially supplied to the plurality of subpixel lines SPL #1 to SPL #n (primary supply) in conformity with the timing at which the plurality of first gate lines GLa are sequentially scanned by a first gate signal SCANa of a turn-on level (primary scanning).

Hereinafter, the reference voltage VREF that is primarily supplied to the subpixels SP through the reference line RL during the primary scanning on the plurality of first gate lines GLa will be referred to as a "first reference voltage VREF1".

The plurality of second gate lines GLb can also be scanned in conformity with the timing at which the plurality of first gate lines GLa are sequentially scanned (primary scanning). Image data voltages VDATA can be sequentially applied to the plurality of subpixel lines SPL #1 to SPL #n in conformity with the timing at which the plurality of second gate lines GLb are sequentially scanned by the second gate signal SCANb of a turn-on level.

Referring to FIGS. 3 and 4, as first driving (primary scanning) is sequentially performed on the plurality of first gate lines GLa, the plurality of subpixel lines SPL #1 to SPL #n can sequentially emit light, so that the display panel 110 is able to display a real image.

Referring to FIGS. 3 and 4, during the secondary scanning of the multi-scanning on the plurality of first gate lines GLa, a reference voltage VREF is sequentially supplied to the plurality of subpixel lines SPL #1 to SPL #n (secondary supply). In other words, reference voltages VREF can be sequentially supplied to the plurality of subpixel lines SPL #1 to SPL #n (secondary supply) in conformity with the timing at which the plurality of first gate lines GLa are sequentially scanned by a first gate signal SCANa of a turn-on level (secondary scanning).

Hereinafter, the reference voltage VREF that is supplied to the subpixels SP (secondary supply) through the reference line RL during the secondary scanning on the plurality of first gate lines GLa will be referred to as a "second reference voltage VREF2".

During the secondary scanning of the multi-scanning on the plurality of first gate lines GLa, a second gate signal SCANb of a turn-off level is being applied to the plurality of second gate lines GLb.

Referring to FIGS. 3 and 4, as the sequential second driving is performed on the plurality of first gate lines GLa, the display panel 110 can display a fake image different from a real image.

As described above, the display panel 110 displays a fake image different from a real image during a portion of one frame time, instead of continuously displaying the real image during one frame time. Accordingly, the embodiments of the present disclosure can improve the motion picture response time (MPRT).

The aforementioned real image can be an image visible to the naked eye of the user, can be an image intended to be displayed, or can be a motion picture that changes with a change in the frame.

The fake image, which is different from the real image, can be an image not visible to the naked eye of a user, can be an image not intended to be displayed, or can be an image that does not change with a change in the frame.

For example, the fake image can be a black image or a low-grayscale image.

A plurality of first transistors T1 controlled by a first gate signal SCANa sequentially supplied through the plurality of first gate lines GLa and a plurality of second transistors T2 controlled by a second gate signal sequentially supplied through the plurality of second gate lines GLb can be arranged on the display panel 110. The plurality of first transistors T1 are included in the plurality of subpixels SP, respectively. The plurality of second transistors T2 are included in the plurality of subpixels SP, respectively.

Referring to FIGS. 4 and 5, a first driving in which the plurality of subpixel lines SPL #1 to SPL #n are sequentially driven so as to display a real image on the display panel 110 and a second driving in which the plurality of subpixel lines SPL #1 to SPL #n are sequentially driven so as to display a fake image on the display panel 110 can be performed during one frame time. For example, each of the plurality of subpixel lines SPL #1 to SPL #n has a first driving time DT1 during which the first driving is performed and a second driving time DT2 during which the second driving is performed during one frame time.

In each of the subpixels SP included in the subpixel line on which the first driving is performed, the first transistor T1 is turned on and then turned off, and the second transistor T2 is turned on and then turned off. At this time, the driving transistor (DT) can be in a positive bias state. For example, in each of the subpixels SP included in the subpixel line on which the first driving is performed, the voltage of the first node N1 of the driving transistor DT can be higher than the voltage of the second node N2 of the driving transistor DT.

In each of the subpixels SP included in the subpixel line on which the second driving is performed, the first transistor T1 is turned on and the second transistor T2 remains in a turn-off state. At this time, the driving transistor DT is in a negative bias state. For example, in each of the subpixels SP included in the subpixel line on which the second driving is performed, the voltage of the first node N1 of the driving transistor DT is lower than the voltage of the second node N2 of the driving transistor DT.

Hereinafter, driving for improving the motion picture response time will be described in more detail.

The subpixels SP included in each subpixel line perform first driving and second driving during one frame time. Here, the first driving can include primary driving (primary scanning) on the first gate line GLa, primary supply of a reference voltage VREF (i.e., the supply of a first reference voltage VREF1), and supply of an image data voltage VDATA. The second driving can include secondary driving (secondary scanning) on the first gate line GLa, and secondary supply of a reference voltage VREF (i.e., the supply of a second reference voltage VREF2).

During one frame time, each of the subpixels SP included in each subpixel line has a first driving time DT1 during which the first driving is performed and a second driving time DT2 during which the second driving is performed.

Each of the subpixels SP included in the subpixel line, on which the first driving is performed, executes a data program and emission in sequence. For example, each of the subpixels SP corresponding to the elapse of the first driving time DT1 has a data program time DPT and an emission time EMT.

In each of the subpixels SP included in the subpixel line on which the first driving is performed, the first transistor T1 can be primarily turned on such that a first reference voltage VREF1 is applied to the first node N1 of the driving transistor DT and the second transistor T2 can be turned on such that an image data voltage VDATA is applied to the second node N2 of the driving transistor DT while the data program is being performed.

For example, each of the subpixels SP corresponding to the elapse of the data program time DPT during the first driving time DT1 receives the first reference voltage VREF1 and the image data voltage VDATA applied thereto.

According to the application of the voltages described above, the driving transistor DT of the subpixels SP corresponding to the elapse of the data program time DPT is in a positive bias state (Vg>Vs).

During the emission of each subpixel SP included in the subpixel line on which the first driving is performed, the first transistor T1 and the second transistor T2 can be turned off, and the voltages of the first node N1 and the second node N2 of the driving transistor DT can be boosted, so that the emission device ED can emit light.

In other words, in each of the subpixels SP corresponding to the elapse of the emission time EMT during the first driving time DT1, a driving current is supplied to the emission device ED by voltage boosting at the second node N2 of the driving transistor DT so that the emission device ED emits light.

The driving transistor DT of each subpixel SP corresponding to the elapse of the emission time EMT is in a positive bias state (Vg>Vs).

According to the sequential emission of the plurality of subpixel lines SPL #1 to SPL #n, the display panel 110 displays a real image.

In each of the subpixels SP included in the subpixel line on which the second driving is performed, the first transistor T1 can be secondarily turned on such that a second reference voltage VREF2 is applied to the first node N1 of the driving transistor DT, and the second transistor T2 remains in a turn-off state.

Accordingly, the driving transistor DT of each subpixel SP included in the subpixel line corresponding to the elapse of the second driving time DT2 is in a negative bias state (Vg<Vs).

In order for the driving transistor DT of each subpixel SP included in the subpixel line corresponding to the elapse of the second driving time DT2 to be in the negative bias state (Vg<Vs), the voltage variation at the second node N2 of the driving transistor DT must not be large. To this end, the capacitance of a capacitor component Ced of the emission device ED can be designed to be larger than the capacitance of the storage capacitor Cst.

As the driving transistor DT of each subpixel SP included in the subpixel line on which the second driving is performed is in the negative bias state (Vg<Vs), the emission device ED can stop emitting light in each of the subpixels SP included in the subpixel line on which the second driving is performed. For example, the subpixels SP included in the subpixel line corresponding to the elapse of the second driving time DT2 can stop emitting light.

When the emission of the plurality of subpixel lines SPL #1 to SPL #n is sequentially stopped by the second driving, it looks as the display panel 110 displays a fake image different from a real image during a portion of one frame time. The fake image displayed on the display panel 110 is implemented by non-emission of the emission devices ED, instead of actual image data provided from the controller 140.

According to this, it is like that a fake image (e.g., a black image) is inserted between the real images that are being displayed. Therefore, the second driving time DT2 is also referred to as a "driving time for black insertion".

Figure 6:
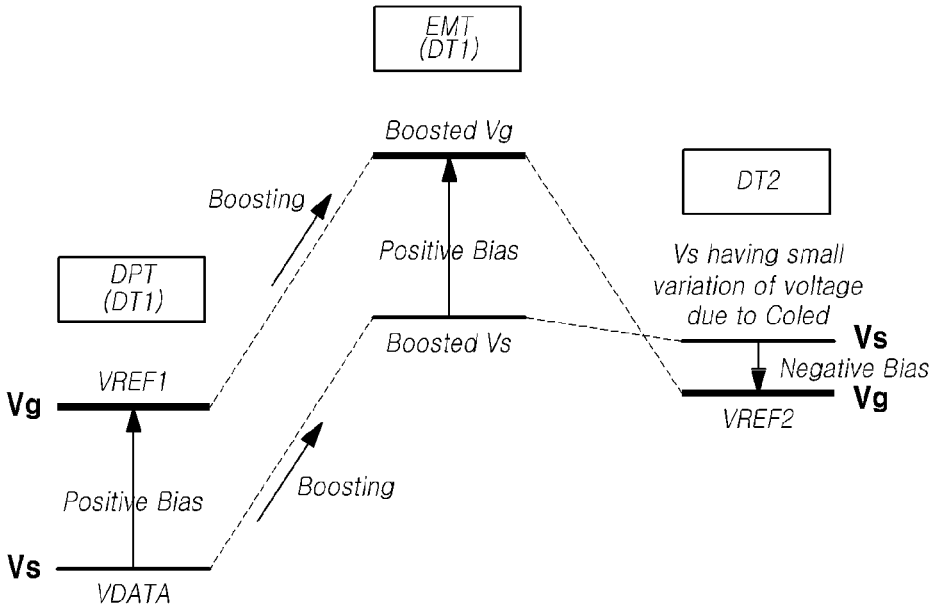
FIG. 6 is a diagram illustrating variations in a gate voltage and a source voltage of a driving transistor in one subpixel in driving for improving the motion picture response time of a display device according to embodiments of the present disclosure.

FIG. 6 is a diagram illustrating variations in a gate voltage Vg and a source voltage Vs of a driving transistor DT in one subpixel SP in driving for improving a motion picture response time of a display device 100 according to embodiments of the present disclosure.

Referring to FIG. 6, in the subpixels SP included in the subpixel line corresponding to the elapse of the data program time DPT during the first driving time DT1, a first reference voltage VREF1 and an image data voltage VDATA are applied to the first node N1 and the second node N2 of the driving transistor DT, respectively.

For example, in the subpixels SP included in the subpixel line corresponding to the elapse of the data program time DPT of the first driving time DT1, the gate voltage Vg and the source voltage Vs of the driving transistor DT are the first reference voltage VREF1 and the image data voltage VDATA, respectively.

In the subpixels SP included in the subpixel line corresponding to the elapse of the data program time DPT of the first driving time DT1, the voltage difference Vgs between the first node N1 and the second node N2 of the driving transistor DT is "VREF1−VDATA".

The first reference voltage VREF1 is higher than the image data voltage VDATA applied to the second node N2 of the driving transistor DT.

Therefore, in the subpixels SP included in the subpixel line corresponding to the elapse of the data program time DPT of the first driving time DT1, the driving transistor DT is in a positive bias state (Vg>Vs).

Referring to FIG. 6, if the first transistor T1 and the second transistor T2 are turned off in the subpixels SP included in the subpixel line corresponding to the elapse of the first driving time DT1, voltages of the first node N1 and the second node N2 of the driving transistor DT are increased (boosted).

If the voltage Vs of the second node N2 of the driving transistor DT in the subpixels SP included in the subpixel line corresponding to the elapse of the first driving time DT1 is boosted to a voltage capable of turning on the emission device ED, the emission device ED emits light.

In the subpixels SP included in the subpixel line corresponding to the elapse of the emission time EMT of the first driving time DT1, a voltage difference Vgs between the first node N1 and the second node N2 of the driving transistor DT is maintained to be the voltage difference of the data program time DPT (Vgs=VREF1−VDATA) despite the voltage boosting. For example, the driving transistor DT is in a positive bias state in the subpixels SP included in the subpixel line corresponding to the elapse of the emission time EMT of the first driving time DT1.

Referring to FIG. 6, in the subpixels SP included in the subpixel line corresponding to the elapse of the second driving time DT1, the first transistor T1 is turned on and the second transistor T2 is turned off. The second reference voltage VREF2 is applied to the first node N1 of the driving transistor DT through the first transistor T1 that is turned on, and the second node N2 of the driving transistor DT remains in a floating state immediately before the second driving.

In this case, the voltage Vs of the second node N2 of the driving transistor DT may not change by the voltage difference Vgs of the data program time DPT and the emission time EMT due to the effect of the capacitor component Ced of the emission device ED, and can have only a small amount of change.

Accordingly, the second reference voltage VREF2 applied to the first node N1 of the driving transistor DT is lower than the boosted voltage Vs of the second node N2 of the driving transistor DT when the emission occurs.

As a result, the voltage Vg of the first node N1 of the driving transistor DT enters a negative bias state in which the voltage Vg is lower than the voltage Vs of the second node N2, so that the emission device ED stops emitting light and so that the corresponding subpixel SP is in a black display state.

As described above, the display panel 110 displays a fake image such as a black image according to the second driving.

As described above, in order to display a fake image such as a black image on the display panel 110 according to the second driving, Equation 1 below must be satisfied.

$$Vg - \left\{(-\Delta v) \times \frac{Cst}{Cst + Ced} + Vs + \Delta V\right\} < \text{Vth_DT} \qquad \text{[Equation 1]}$$

$$\therefore \frac{Cst}{Cst + Ced} < 1 - \frac{Vgs - \text{Vth_DT}}{\text{Vth_ED} - Vs}$$

Equation 1 is a conditional equation in which the driving transistor DT is turned off when Vgs<Vth_DT. In Equation 1, "Vg" is a voltage of the first node N1 of the driving transistor DT, and "Vs" is a voltage of the second node N2 of the driving transistor DT. "Vgs" is a voltage difference between the first node N1 and the second node N2 of the driving transistor DT. "Cst" is capacitance of the storage capacitor. "Ced" is capacitance of the emission device ED. "Vth_DT" is a threshold voltage of the driving transistor DT, and "Vth_ED" is a threshold voltage of the emission device ED. "ΔV" is a voltage change value and has a value similar to "Vth_ED−Vs". "ΔV+Vs" can be equal or similar to "Vth_ED". By considering this, the equation "Cst/(Cst+Ced)<1−(Vgs−Vth_DT)/(Vth_ED−Vs)" can be obtained from Equation 1 by summarizing the same. "Cst" and "Ced" can be configured by utilizing the equation above.

Since the voltage Vs of the second node N2 of the driving transistor DT is an image data voltage VDATA, "Vs" must be lower than a threshold voltage Vth_ED of the emission device ED for driving, and the voltage Vg of the first node N1 of the driving transistor DT must satisfy the following conditions in order to implement a black level.

Condition 1) Vg_max<Vth_ED+margin1

Condition 2) Vs<Vth_DT+Vs_max+margin2

Figure 7:
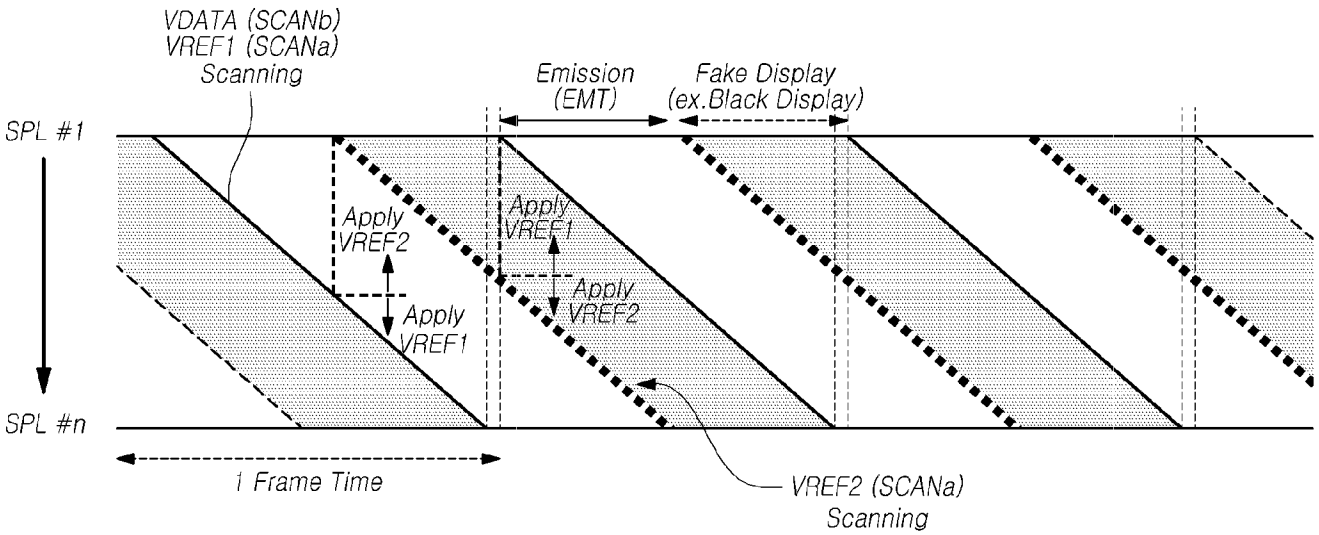
FIG. 7 is a diagram illustrating the supply of a reference voltage in driving for improving the motion picture response time of a display device according to embodiments of the present disclosure.

FIG. 7 is a diagram illustrating the supply of a reference voltage in driving for improving the motion picture response time of a display device 100 according to embodiments of the present disclosure.

Referring to FIG. 7, while a first subpixel line among a plurality of subpixel lines SPL #1 to SPL #n performs a data program in the first driving, a subpixel line that is different from the first subpixel line can perform the second driving.

While a first reference voltage VREF1 is applied to a plurality of subpixels SP included in the first subpixel line among the plurality of subpixel lines SPL #1 to SPL #n, a second reference voltage VREF2 can be applied to a plurality of subpixels SP included a subpixel line that is different from the first subpixel line.

Referring to FIG. 7, while a second subpixel line among the plurality of subpixel lines SPL #1 to SPL #n performs the second driving, a subpixel line that is different from the second subpixel line can perform a data program in the first driving.

While a second reference voltage VREF2 is applied to a plurality of subpixels SP included in the second subpixel line among the plurality of subpixel lines SPL #1 to SPL #n, a first reference voltage VREF1 can be applied to a plurality of subpixels SP included in a subpixel line that is different from the second subpixel line.

Figure 8:
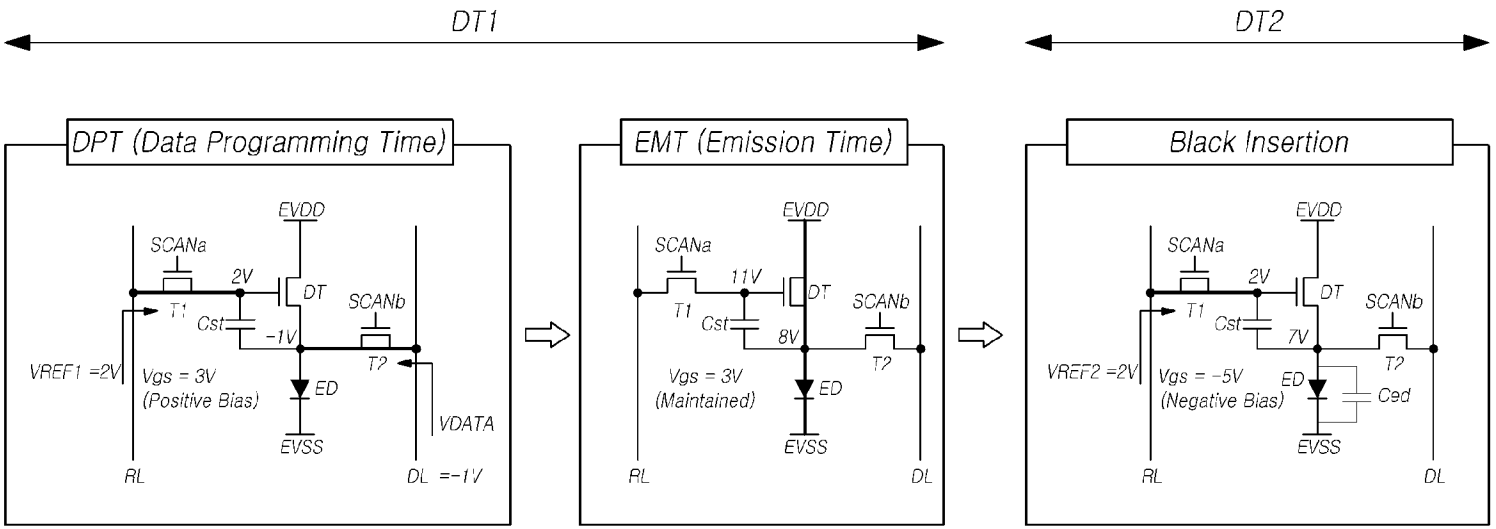
FIG. 8 is a diagram illustrating the case of using a constant reference voltage in driving for improving the motion picture response time of a display device according to embodiments of the present disclosure.
Figure 9:
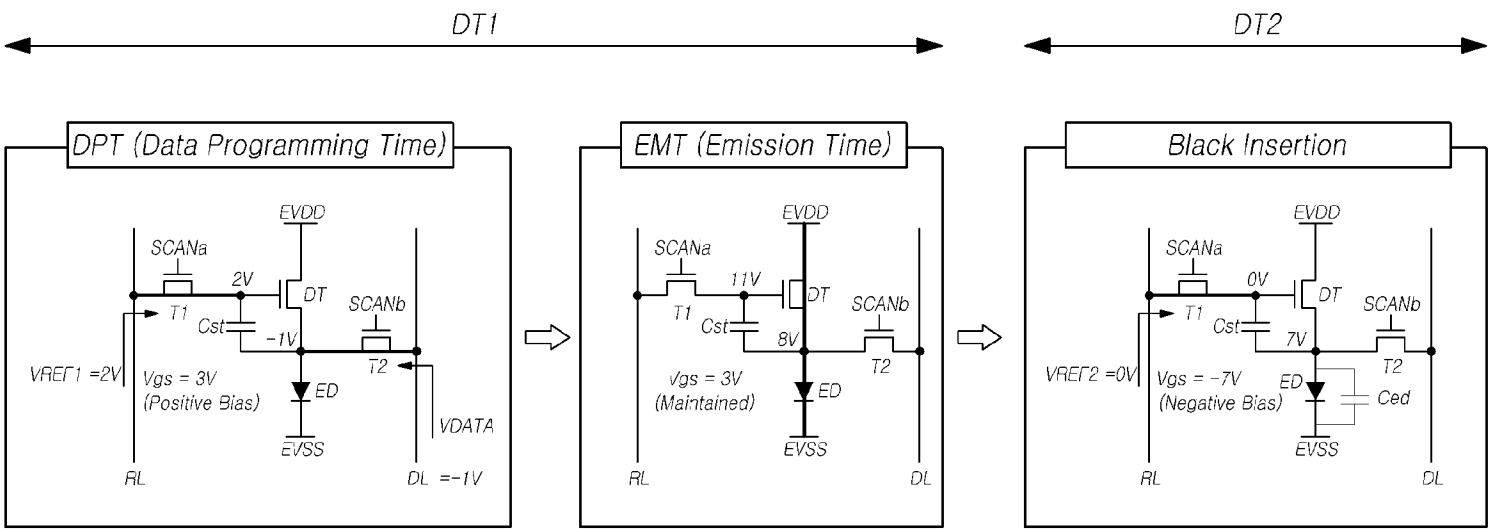
FIG. 9 is a diagram illustrating the case of varying a reference voltage in driving for improving the motion picture response time of a display device according to embodiments of the present disclosure.

FIG. 8 is a diagram illustrating the case of using a constant reference voltage in driving for improving the motion picture response time of a display device 100 according to embodiments of the present disclosure, and FIG. 9 is a diagram illustrating the case of varying a reference voltage in driving for improving the motion picture response time of a display device 100 according to embodiments of the present disclosure.

Referring to FIG. 8, a first reference voltage VREF1 applied to the first node N1 of the driving transistor DT through a reference line RL during the first driving and the second reference voltage VREF2 applied to the first node N1 of the driving transistor DT through a reference line RL during the second driving can have the same value (e.g., 2 V).

According to the example shown in FIG. 8, during the data program time DPT of the first driving time DT1, if the first reference voltage VREF1 applied to the first node N1 of the driving transistor DT of a corresponding subpixel SP is 2 V, and if the image data voltage VDATA applied to the second node N2 of the driving transistor DT of the corresponding subpixel SP is −1 V, the potential difference Vgs between both ends of the storage capacitor Cst is 3 V {=2 V−(−1 V)}.

According to the example shown in FIG. 8, during the emission time EMT of the first driving time DT1, the first node N1 and the second node N2 of the driving transistor DT of a corresponding subpixel SP are floated, respectively, and the voltages thereof are boosted.

For example, during the emission time EMT of the first driving time DT1, the first node N1 and the second node N2 of the driving transistor DT of the corresponding subpixel SP can be boosted to 11 V and 8 V, respectively. In spite of the voltage boosting, the voltage difference Vgs between the first node N1 and the second node N2 of the driving transistor DT is maintained at 3 V (=11 V−8 V).

According to the example shown in FIG. 8, a second reference voltage VREF2 is applied to the first node N1 of the driving transistor DT of a corresponding subpixel SP during the second driving time DT2. The second reference voltage VREF2 is 2 V, which is equal to the first reference voltage VREF1.

The voltage variation at the second node N2 of the driving transistor DT is not so large due to the capacitor component Ced of the emission device ED during the second driving time DT2. For example, the voltage of the second node N2 of the driving transistor DT can be lowered only to about 7 V. Accordingly, the voltage difference Vgs between the first node N1 and the second node N2 of the driving transistor DT has a negative value (2 V−7 V=−5 V). Accordingly, the emission device ED may not emit light.

Referring to FIG. 9, the second reference voltage VREF2 applied to the first node N1 of the driving transistor DT through the reference line RL during the second driving can have a value (e.g., 0 V) lower than the voltage value of the first reference voltage VREF1 (e.g., 2 V) applied to the first node N1 of the driving transistor DT through the reference line RL during the first driving.

According to the example shown in FIG. 9, if the first reference voltage VREF1 applied to the first node N1 of the driving transistor DT of a corresponding subpixel SP is 2 V, and if the image data voltage VDATA applied to the second node N2 of the driving transistor DT of the corresponding subpixel SP is −1 V during the data program time DPT of the first driving time DT1, the potential difference Vgs between both ends of the storage capacitor Cst is 3 V {=2 V−(−1 V)}.

According to the example shown in FIG. 9, during the emission time EMT of the first driving time DT1, the first node N1 and the second node N2 of the driving transistor DT of a corresponding subpixel SP are floated, respectively, and the voltages thereof are boosted.

For example, during the emission time EMT of the first driving time DT1, the first node N1 and the second node N2 of the driving transistor DT of a corresponding subpixel SP can be boosted to have voltages of 11 V and 8 V, respectively. In spite of the voltage boosting, the voltage difference Vgs between the first node N1 and the second node N2 of the driving transistor DT is maintained at 3 V(=11V−8 V).

According to the example shown in FIG. 9, a second reference voltage VREF2 is applied to the first node N1 of the driving transistor DT of a corresponding subpixel SP during the second driving time DT2. The second reference voltage VREF2 is 0 V, which is lower than the first reference voltage VREF1.

The voltage variation at the second node N2 of the driving transistor DT is not so large due to the capacitor component Ced of the emission device ED during the second driving time DT2. For example, the voltage of the second node N2 of the driving transistor DT can be lowered only to about 7 V. Accordingly, the voltage difference Vgs between the first node N1 and the second node N2 of the driving transistor DT has a negative value (=0 V−7 V=−7 V). Accordingly, the emission device ED may not emit light.

Figure 10:
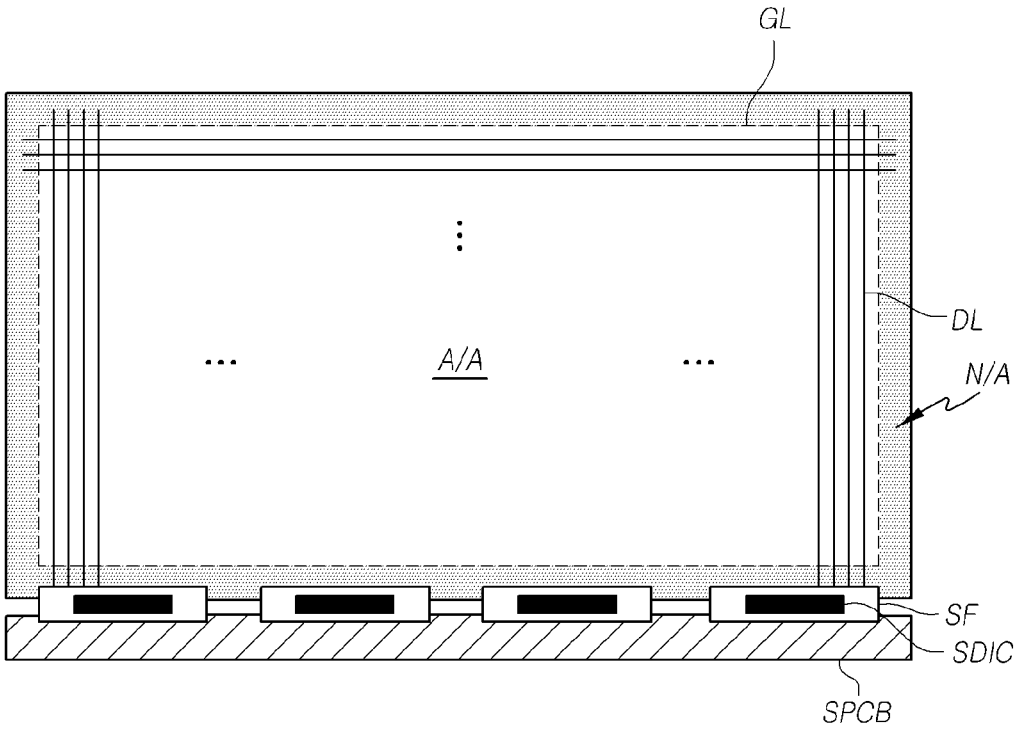
FIG. 10 is a diagram illustrating a display device according to embodiments of the present disclosure.

FIG. 10 is a diagram illustrating a display device 100 according to embodiments of the present disclosure.

Referring to FIG. 10, in the display device 100 according to embodiments of the present disclosure, the data driving circuit 120 can be implemented by a chip-on-film (COF) type. In this case, the data driving circuit 120 can include one or more source driver integrated circuits SDIC mounted on a circuit film SF. In this case, one side and the other side of the circuit film SF are bonded to the display panel 110 and the printed circuit board SPCB, respectively.

Referring to FIG. 10, the display panel 110 can include an active area A/A in which an image is displayed and a non-active area N/A that is outer area of the active area A/A.

The plurality of subpixels SP are arranged in the active area A/A.

Various signal wires can be arranged in the non-active region N/A. The various signal wires arranged in the non-active area N/A can include link wires for electrically connecting a plurality of data lines DL in the active area A/A to one or more source driver integrated circuits SDIC, and link wires for connecting a plurality of gate lines GL in the active area A/A to the non-active area N/A. In some cases, a GIP type gate driving circuit 130 can be provided in the non-active area N/A. The signal wire formed in the non-active region N/A is also called a "line-on-glass (LOG)".

Figure 11:
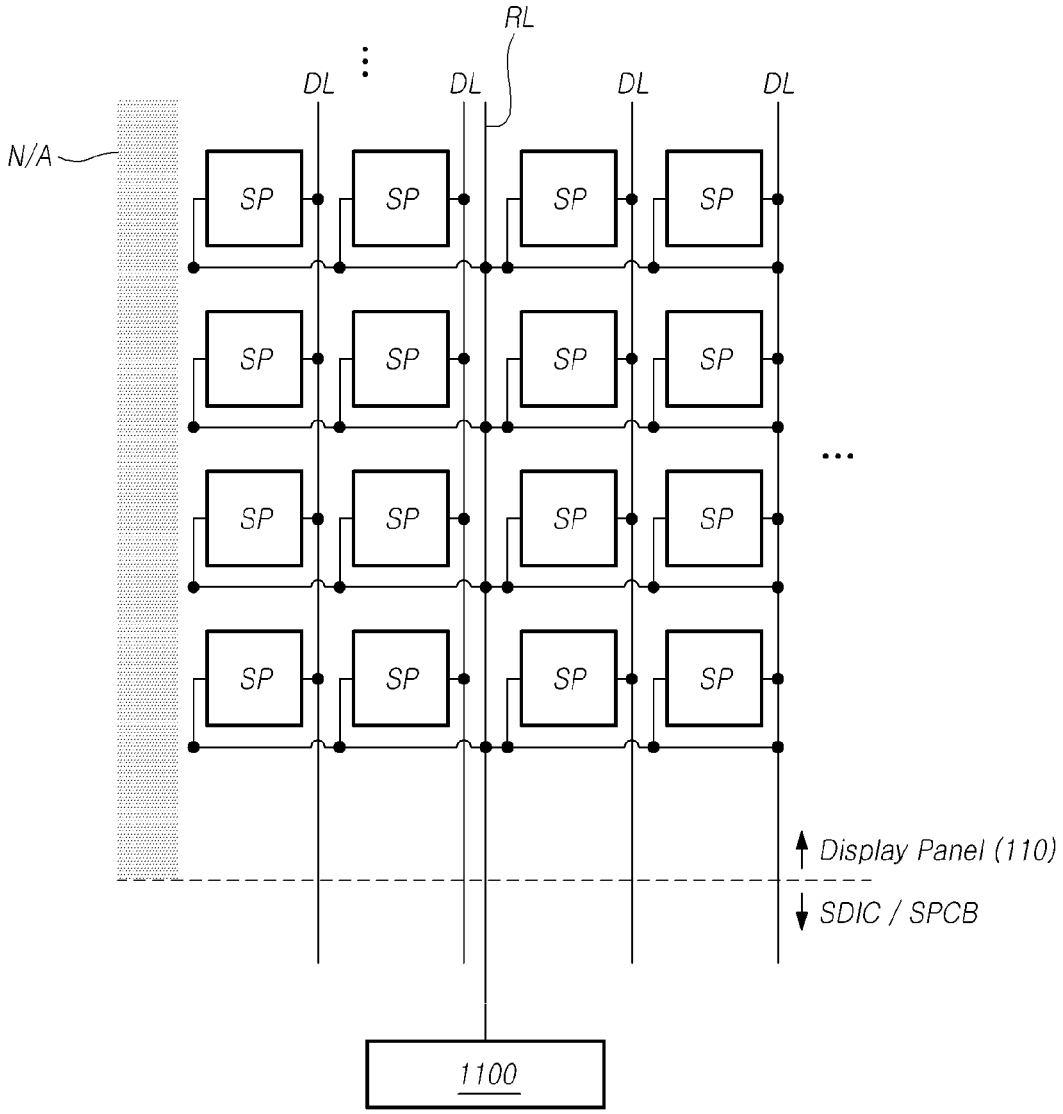
FIGS. 11 to 13 are diagrams illustrating examples of a reference voltage supply structure in a display device according to embodiments of the present disclosure.
Figure 12:
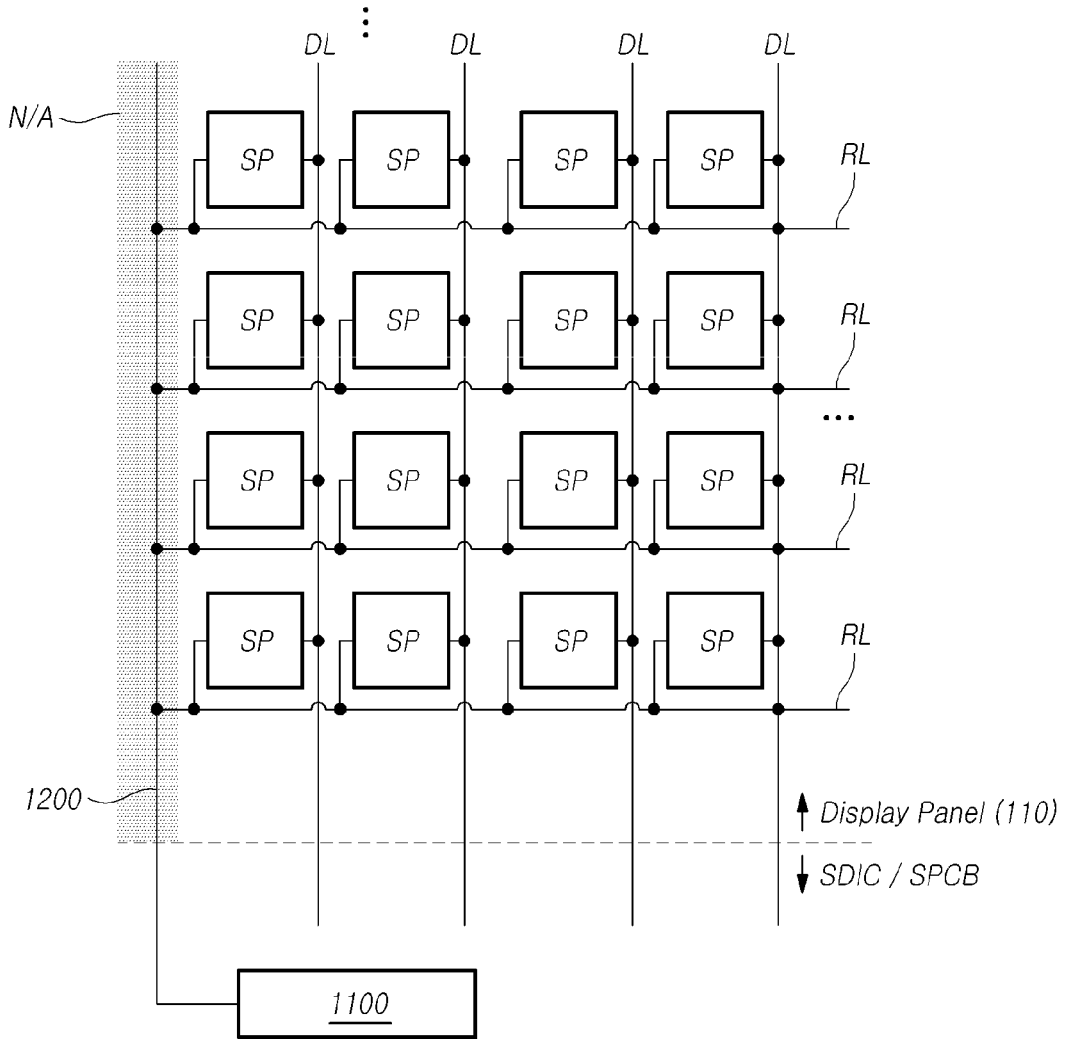
Figure 13:
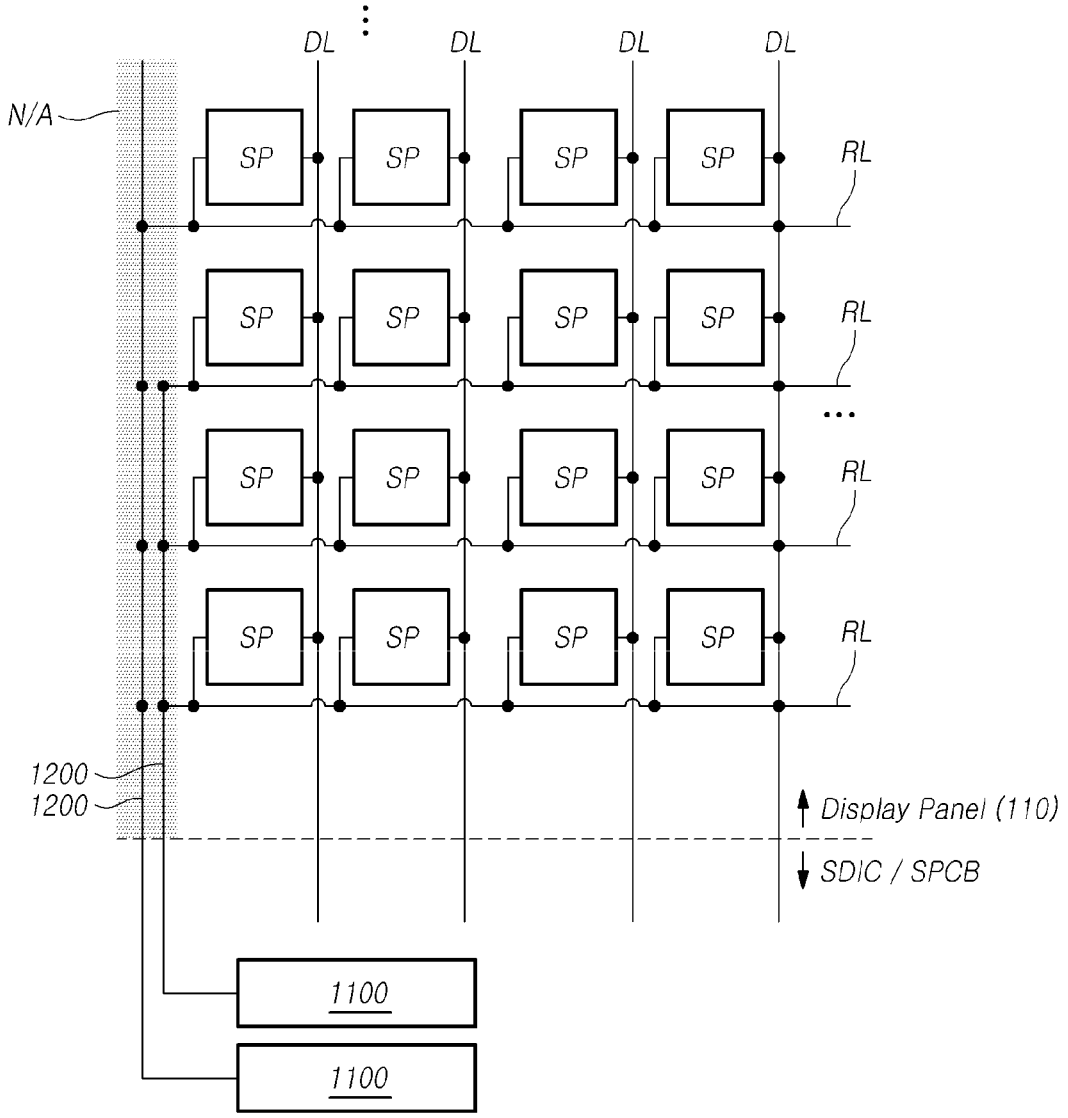

FIGS. 11 to 13 are diagrams illustrating examples of a reference voltage supply structure in a display device 100 according to embodiments of the present disclosure.

Referring to FIG. 11 to FIG. 13, the display device 100 according to embodiments of the present disclosure can include at least one reference voltage supply circuit 1100 provided in a source driver integrated circuit SDIC or a printed circuit board SPCB so as to supply either a first reference voltage VREF1 or a second reference voltage VREF2 to a plurality of reference lines RL.

The at least one reference voltage supply circuit 1100 can include a switch for selecting one of the first reference voltage VREF1 and the second reference voltage VREF2 and outputting the same to the reference line RL.

Referring to FIG. 11, the plurality of reference lines RL can be arranged in parallel to the plurality of data lines DL. For example, in the case where the plurality of data lines DL are arranged in a column direction, the plurality of reference lines RL can be arranged in the column direction.

Each of the plurality of reference lines RL arranged in parallel to the plurality of data lines DL can be arranged for every one or more subpixel columns. In the example shown in FIG. 11, four subpixel columns share one reference line RL.

The reference voltage VREF supplied to the plurality of reference lines RL can be changed to one of the first reference voltage VREF1 and the second reference voltage VREF2 in the source driver integrated circuit SDIC included in the data driving circuit 120 or the printed circuit board SPCB connected to the source driver integrated circuit SDIC.

Referring to FIG. 12, the plurality of reference lines RL can be arranged in parallel to the plurality of gate lines GL. For example, in the case where the plurality of data lines DL are arranged in a column direction and where the plurality of gate lines GL are arranged in a row direction, the plurality of reference lines RL can be arranged in the row direction.

All of the plurality of reference lines RL arranged in parallel to the plurality of gate lines GL can be electrically connected to a single outer wire 1200 arranged in the non-active area N/A.

The reference voltage VREF supplied to the single outer wire 1200 arranged in the non-active area N/A can be changed to one of the first reference voltage VREF1 and the second reference voltage VREF2 in the source driver integrated circuit SDIC included in the data driving circuit 120 or the printed circuit board SPCB connected to the source driver integrated circuit SDIC.

Referring to FIG. 13, the plurality of reference lines RL can be arranged in parallel to the plurality of gate lines GL.

The plurality of reference lines RL arranged in parallel to the plurality of gate lines GL can be grouped into two or more, and can be electrically connected to two or more outer wires 1200 arranged in the non-active area N/A.

The reference voltage VREF supplied to the respective ones of the two or more outer wires 1200 can be changed to one of the first reference voltage VREF1 and the second reference voltage VREF2 in the source driver integrated circuit SDIC included in the data driving circuit 120 or the printed circuit board SPCB connected to the source driver integrated circuit SDIC.

Figure 14:
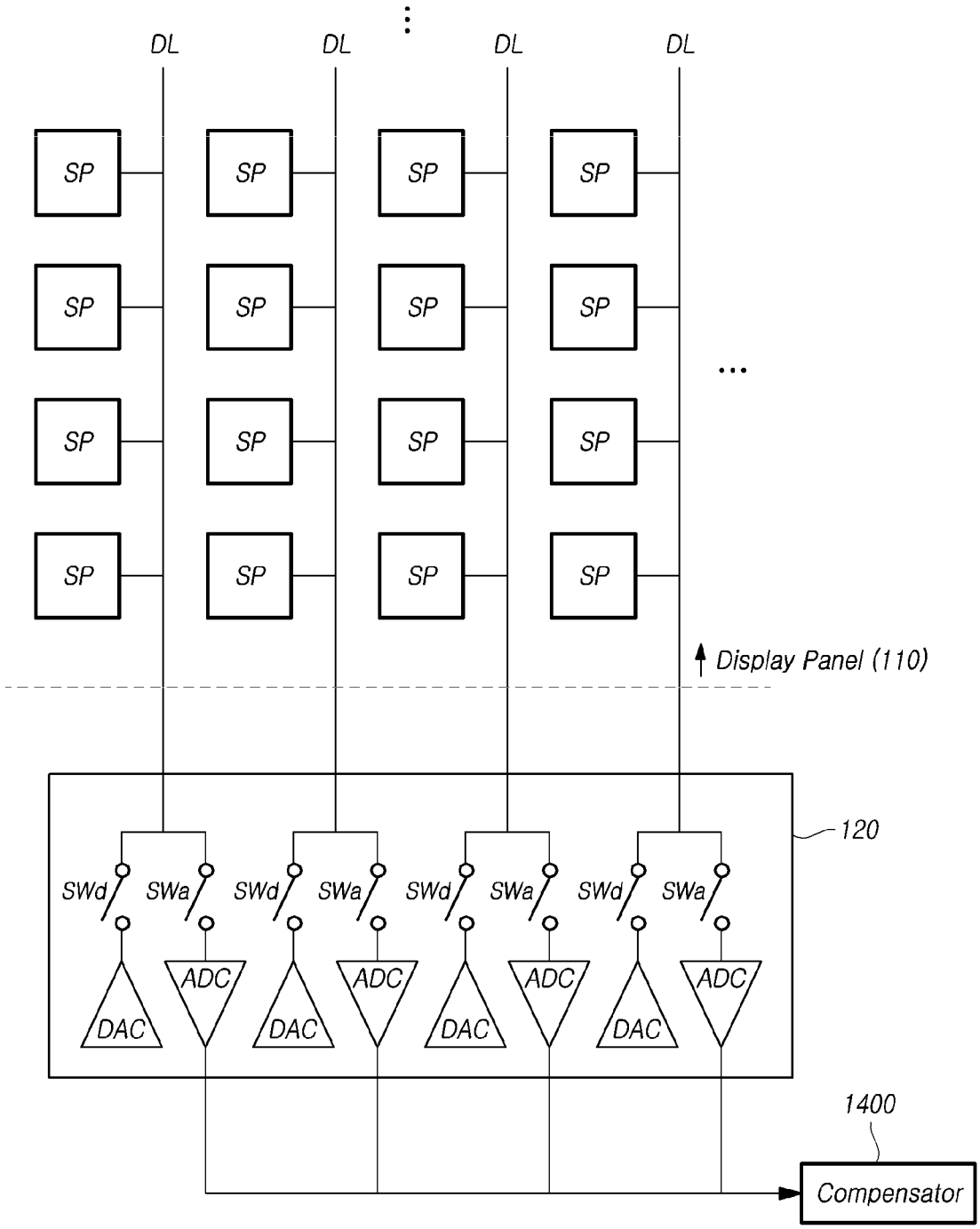
FIGS. 14 and 15 are diagrams illustrating examples of a data driving circuit according to embodiments of the present disclosure.
Figure 15:
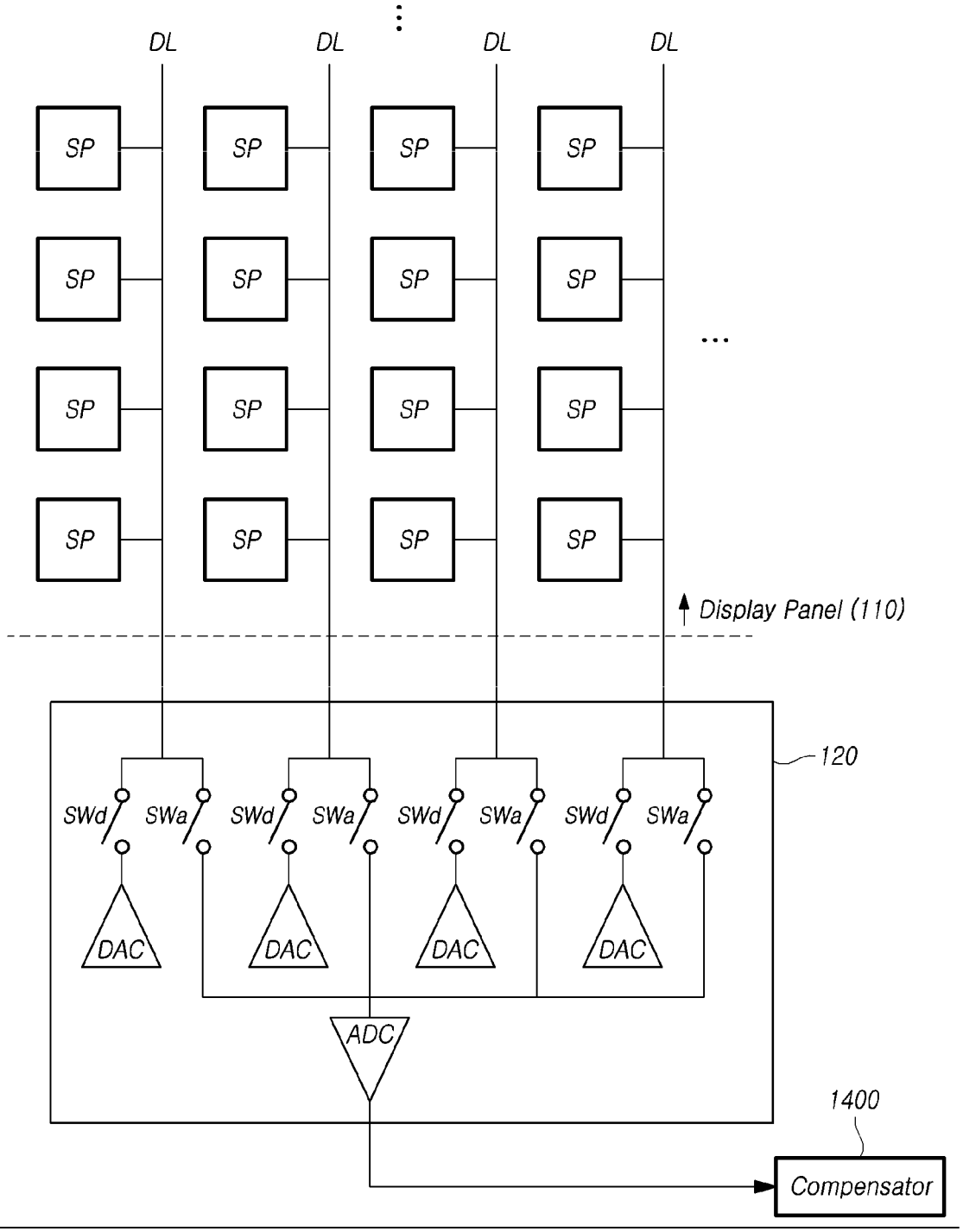

FIGS. 14 and 15 are diagrams illustrating examples of a data driving circuit 120 according to embodiments of the present disclosure.

Referring to FIG. 14, a data driving circuit 120 according to embodiments of the present disclosure can include K digital-to-analog converters DAC and K analog-to-digital converters ADC corresponding to K data lines DL. Here, K is a natural number of 2 or more. For example, each data line DL has one digital-to-analog converter DAC and one analog-to-digital converter ADC correspond thereto.

One of the K data lines DL can be electrically connected to one of the K digital-to-analog converters DAC through one or more first switches SWa, or can be connected to one of the K analog-to-digital converters ADC through one or more second switches SWb.

Referring to FIG. 15, a data driving circuit 120 according to embodiments of the present disclosure can include K digital-to-analog converters DAC corresponding to K data lines DL and one analog-to-digital converter ADC corresponding to k data lines DL.

For example, each data line DL is electrically connected to one digital-to-analog converter DAC, and k data lines DL share one analog-to-digital converter ADC.

One of the K data lines DL can be electrically connected to one of the K digital-to-analog converters DAC through one or more first switches SWd, or can be connected to the analog-to-digital converter ADC through one or more second switches SWa.

The K data lines DL mentioned above, for example, can correspond to four subpixel columns (e.g., a red subpixel column, a green subpixel column, a blue subpixel column, and a white subpixel column). For example, K can be 4.

Referring to FIGS. 14 and 15, in order for the data line DL to be supplied with an image data voltage VDATA when driving the display, the data line DL can be connected to the digital-to-analog converter DAC among the digital-to-analog converter DAC and the analog-to-digital converter ADC.

Referring to FIGS. 14 and 15, in the case of sensing driving, the digital-to-analog converter DAC and the data line DL can be connected; the analog-to-digital converter ADC and the data line DL can be connected; or the data line DL may not be connected to any one of the digital-to-analog converter DAC and the analog-to-digital converter ADC.

The analog-to-digital converter ADC can sense a voltage of the second node N2 of the driving transistor DT in a corresponding subpixel SP, on which sensing driving is performed, through a corresponding data line DL, can convert the sensed voltage to a digital sensed value, and can transmit the same to a compensator 1400.

The compensator 1400 calculates a compensation value to compensate for a threshold voltage or mobility of the driving transistor DT in the corresponding subpixel SP on the basis of the sensed value received from the data driving circuit 120, and stores the compensation value in a memory. In this case, the compensator 1400 can be provided inside or outside the controller 140.

The compensation value calculated above is used to change the image data for compensating for a threshold voltage or mobility when driving a display. The sensing driving mentioned above will be briefly described.

The threshold voltage sensing driving is performed through three steps (an initialization step, a tracking step, and a sensing step).

In the initialization step, the display device 100 turns on both the first transistor T1 and the second transistor T2 in a corresponding subpixel SP, thereby applying a reference voltage VREF and a data voltage for threshold voltage sensing driving to the first node N1 and the second node N2 of the driving transistor DT in the corresponding subpixel SP, respectively.

The data line DL is connected to a digital-to-analog converter DAC in order to receive the data voltage for threshold voltage sensing driving supplied thereto.

In the tracking step, the display device 100 boosts the voltage of the second node N2 of the driving transistor DT by floating the second node N2 of the driving transistor DT in the corresponding subpixel SP.

The display device 100 can release the connection between the data line DL and the digital-to-analog converter DAC in order to float the second node N2 of the driving transistor DT in the corresponding subpixel SP.

The voltage of the second node N2 of the driving transistor DT increases until the difference between the voltage of the first node N1 (a reference voltage) and the voltage of the second node N2 of the driving transistor DT reaches a constant voltage (corresponding to a threshold voltage) and then becomes saturated.

In the sensing step, the data line DL is electrically connected to the analog-to-digital converter ADC. Accordingly, the analog-to-digital converter ADC senses the saturated voltage of the second node N2 of the driving transistor DT through the data line DL. At this time, the sensed voltage can correspond to "VREF-Vth" (Vth: threshold voltage of DT).

The compensator 1400 can obtain the threshold voltage Vth from the sensed voltage (VREF-Vth) and the known reference voltage VREF, or can calculate a compensation value for compensating for the threshold voltage Vth.

The mobility sensing driving is performed through three steps (an initialization step, a tracking step, and a sensing step).

In the initialization step, the display device 100 turns on both the first transistor T1 and the second transistor T2 in a corresponding subpixel SP, thereby applying a reference voltage VREF and a data voltage for mobility sensing driving to the first node N1 and the second node N2 of the driving transistor DT in the corresponding subpixel SP, respectively.

The data line DL is connected to the digital-to-analog converter DAC in order to receive a data voltage for mobility voltage sensing driving supplied thereto.

In the tracking step, the display device 100 boosts the voltages of the first node N1 and the second node N2 of the driving transistor DT by floating the first node N1 and the second node N2 of the driving transistor DT in the corresponding subpixel SP.

The display device 100 can release the connection between the data line DL and the digital-to-analog converter DAC in order to float the second node N2 of the driving transistor DT in the corresponding subpixel SP.

If the voltages of the first node N1 and the second node N2 of the driving transistor DT increase for a predetermined time (t), a sensing step is performed. At this time, the increase in the voltage (ΔV) during the predetermined time (t) is proportional to the mobility of the driving transistor DT.

In the sensing step, the data line DL is electrically connected to the analog-to-digital converter ADC. Accordingly, the analog-to-digital converter ADC senses the increased voltage of the second node N2 of the driving transistor DT through the data line DL. At this time, a voltage increase rate (ΔV/t) of the second node N2 of the driving transistor DT for the predetermined time (t) is proportional to the mobility of the driving transistor DT.

The compensator 1400 can obtain the mobility of the driving transistor DT on the basis of the sensed voltage, or can calculate a compensation value for compensating for the mobility.

Figure 16:
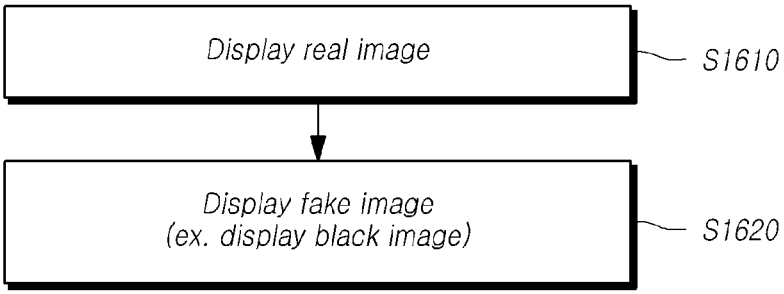
FIG. 16 is a flowchart illustrating a driving method of a display device according to embodiments of the present disclosure.

FIG. 16 is a flowchart illustrating a driving method of a display device 100 according to embodiments of the present disclosure.

A display device 100 according to embodiments of the present disclosure can include a display panel 110 having a plurality of data lines DL, a plurality of first gate lines GLa, a plurality of second gate lines GLb, and a plurality of reference lines RL, which are arranged thereon, and including a plurality of subpixels SP; a data driving circuit 120 for driving the plurality of data lines DL; and a gate driving circuit 130 for driving the plurality of first gate lines GLa and the plurality of second gate lines GLb.

A driving method of the display device 100 according to embodiments of the present disclosure can include a step of displaying a real image on the display panel 110 by sequentially scanning the plurality of first gate lines GLa and the plurality of second gate lines GLb during a first time in one frame time (S1610); and a step of displaying a fake image different from the real image on the display panel 110 by sequentially scanning the plurality of first gate lines GLa during a second time different from the first time in one frame time (S1620).

Each of the plurality of subpixels SP can include an emission device ED, a driving transistor DT for driving the emission device ED, a first transistor T1, a second transistor T2, and a storage capacitor Cst.

The first transistor T1 can be controlled by a first gate signal SCANa supplied through a corresponding first gate line GLa of the plurality of first gate lines GLa, and can electrically connect the first node N1 of the driving transistor DT to the reference line RL.

The second transistor T2 can be controlled by a second gate signal supplied through a corresponding second gate line GLb of the plurality of second gate lines GLb, and can electrically connect the second node N2 of the driving transistor DT to the data line DL.

The storage capacitor Cst can be electrically connected between the first node N1 and the second node N2 of the driving transistor DT.

The first node N1 of the driving transistor DT can be a gate node of the driving transistor DT, and the second node N2 of the driving transistor DT can be a source node or a drain node.

In step S1610, during the first time, the voltage of the first node N1 of the driving transistor DT is higher than the voltage of the second node N2 of the driving transistor DT. For example, the driving transistor DT is in a positive bias state.

In step S1620, during the second time, the voltage of the first node N1 of the driving transistor DT is lower than the voltage of the second node N2 of the driving transistor DT. For example, the driving transistor DT is in a negative bias state.

The real image can be an image that is visible to the naked eye of a user, can be an image intended to be displayed, or can be a motion picture that changes with a change in the frame.

The fake image, which is different from the real image, can be an image not visible to the naked eye of the user, can be an image not intended to be displayed, or can be an image that does not change with a change in the frame.

Figure 17:
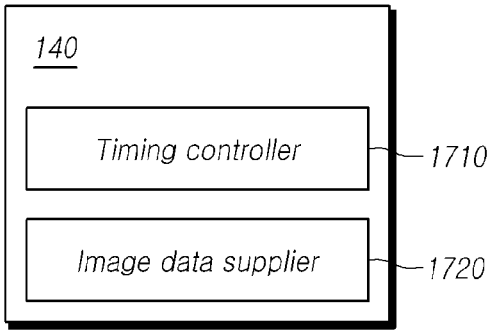
FIG. 17 is a block diagram of a controller in a display device according to embodiments of the present disclosure.

FIG. 17 is a block diagram of a controller 140 of a display device 100 according to embodiments of the present disclosure.

Referring to FIG. 17, a controller 140 of the display device 100 according to embodiments of the present disclosure includes a timing controller 1710 for controlling the gate driving circuit 130 and the data driving circuit 120, and an image data supplier 1720 for outputting image data DATA.

The timing controller 1710 can perform control such that the gate driving circuit 130 sequentially drives the plurality of first gate lines GLa during a first time in one frame time.

The timing controller 1710 can perform control such that the gate driving circuit 130 sequentially drives a plurality of first gate lines GLa and the plurality of second gate lines GLb during a second time that is different from the first time in one frame time.

The timing controller 1710 can perform control such that the data driving circuit 120 outputs an image data voltage VDATA corresponding to image data to a plurality of data lines DL when the gate driving circuit 130 sequentially scans the plurality of first gate lines and the plurality of second gate lines during the first time.

A real image can be displayed on the display panel 110 during the first time.

A fake image different from the real image can be displayed on the display panel 110 during the second time.

The real image can be an image that is visible to the naked eye of a user, can be an image intended to be displayed, or can be a motion picture that changes with a change in the frame.

The fake image, which is different from the real image, can be an image not visible to the naked eye of the user, can be an image not intended to be displayed, or can be an image that does not change with a change in the frame.

Figure 18:
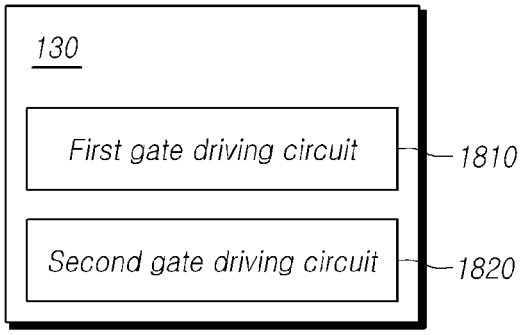
FIG. 18 is a block diagram of a gate driving circuit in a display device according to embodiments of the present disclosure.

FIG. 18 is a block diagram of a gate driving circuit 130 of a display device 100 according to embodiments of the present disclosure.

Referring to FIG. 18, a gate driving circuit 130 of the display device 100 according to embodiments of the present disclosure can drive a plurality of first gate lines GLa and a plurality of second gate lines GLb arranged on a display panel 110.

The gate driving circuit 130 can include a first gate driving circuit 1810 for driving the plurality of first gate lines GLa and a second gate driving circuit 1820 for driving the plurality of second gate lines GLb.

The first gate driving circuit 1810 can sequentially drive the plurality of first gate lines GLa during a first time in one frame time.

The first gate driving circuit 1810 can sequentially drive the plurality of first gate lines GLa during a second time different from the first time in one frame time.

The second gate driving circuit 1820 can sequentially drive the plurality of second gate lines GLb during the first time when the plurality of first gate lines GLa are sequentially driven.

During the first time, an image data voltage VDATA can be applied to a plurality of data lines DL when the second gate driving circuit 1820 sequentially drives the plurality of second gate lines GLb.

A real image can be displayed on the display panel 110 during the first time.

A fake image different from the real image can be displayed on the display panel 110 during the second time.

The real image can be an image that is visible to the naked eye of a user, can be an image intended to be displayed, or can be a motion picture that changes with a change in the frame.

The fake image, which is different from the real image, can be an image not visible to the naked eye of the user, can be an image not intended to be displayed, or can be an image that does not change with a change in the frame.

According to the embodiments of the present disclosure described above, it is possible to improve the image quality through driving for easily improving the motion picture response time.

In addition, according to embodiments of the present disclosure, it is possible to provide a new subpixel structure capable of improving the motion picture response time.

In addition, according to embodiments of the present disclosure, it is possible to easily improve the motion picture response time through a multi-scanning operation by first transistors T1 as switching devices.

In addition, according to embodiments of the present disclosure, it is possible to improve the motion picture response time by intermittently displaying a fake image (e.g., a black images) different from a real image while the real image is being displayed.

Further, according to embodiments of the present disclosure, it is possible to easily improve the motion picture response time by controlling a bias state in a subpixel through on/off control of switching devices T1 and T2 without supplying image data, thereby intermittently displaying a fake image (e.g., a black images) different from a real image while the real image is being displayed.

The above description has been presented to enable any person skilled in the art to make and use the technical idea of the present disclosure, and has been provided in the context of a particular application and its requirements. Various modifications, additions and substitutions to the described embodiments will be readily apparent to those skilled in the art, and the general principles defined herein can be applied to other embodiments and applications without departing from the spirit and scope of the present disclosure. The above description and the accompanying drawings provide an example of the technical idea of the present disclosure for illustrative purposes only. That is, the disclosed embodiments are intended to illustrate the scope of the technical idea of the present disclosure. Thus, the scope of the present disclosure is not limited to the embodiments shown, but is to be accorded the widest scope consistent with the claims. The scope of protection of the present disclosure should be construed based on the following claims, and all technical ideas within the scope of equivalents thereof should be construed as being included within the scope of the present disclosure.

What is claimed is:

1. A display device comprising:

a display panel including a plurality of data lines, a plurality of first gate lines, a plurality of second gate lines, and a plurality of reference lines arranged thereon, the display panel further including a plurality of subpixels including an emission device, a driving transistor, and a storage capacitor;

a data driving circuit configured to be electrically connected to the plurality of data lines; and a gate driving circuit configured to be electrically connected to the plurality of first gate lines and the plurality of second gate lines, wherein the plurality of subpixels constitute a plurality of subpixel lines, and the plurality of subpixel lines correspond to the plurality of first gate lines, wherein the display panel has a plurality of first transistors controlled by first gate signals sequentially supplied through the plurality of first gate lines and a plurality of second transistors controlled by second gate signals sequentially supplied through the plurality of second gate lines, which are arranged thereon, wherein the plurality of first transistors are included in the plurality of subpixels, respectively, and the plurality of second transistors are included in the plurality of subpixels, respectively, wherein in each of the plurality of subpixels, a first transistor is controlled by a first gate signal supplied through the first gate line and electrically connects a first node of the driving transistor to the reference line, and the first node of the driving transistor is a gate node of the driving transistor, wherein a second transistor is controlled by a second gate signal supplied through the second gate line and electrically connects a second node of the driving transistor to the data line, and the second node of the driving transistor is a source node or a drain node of the driving transistor, wherein the gate driving circuit sequentially drives each of the plurality of first gate lines twice during one frame time including a first driving time and a second driving time after the first driving time, wherein during the first driving time in the one frame time, as each of the plurality of first gate lines are primarily driven in sequence for allowing a first reference voltage to be applied to the first node of the driving transistor, the display panel displays a real image, wherein during the second driving time in the one frame time, as each of the plurality of first gate lines are secondarily driven in sequence for allowing a second reference voltage to be applied to the first node of the driving transistor, the display panel displays a fake image different from the real image, wherein, during the one frame time, both a first driving for sequentially driving the plurality of subpixel lines so as to display the real image on the display panel and a second driving for sequentially driving the plurality of subpixel lines so as to display the fake image on the display panel are performed, wherein the first transistor is turned on and then turned off and the second transistor is turned on and then turned off in each subpixel included in the subpixel line on which the first driving is performed, wherein the first transistor is turned on and the second transistor is maintained to be turned off in each subpixel included in the subpixel line on which the second driving is performed, wherein a data program and emission are sequentially performed in each subpixel included in the subpixel line on which the first driving is performed, wherein the first transistor is primarily turned on so that the first reference voltage is applied to the first node of the driving transistor and the second transistor is turned on so that an image data voltage is applied to the second node of the driving transistor while the data program is being performed in each subpixel included in the subpixel line on which the first driving is performed, wherein the first transistor and the second transistor are turned off, the voltages of the first node and the second node of the driving transistor are boosted, and then the emission device emits light while the emission is being performed in each subpixel included in the subpixel line on which the first driving is performed, and wherein, in each subpixel included in the subpixel line on which the second driving is performed, the first transistor is secondarily turned on so that the second reference voltage is applied to the first node of the driving transistor, the second transistor remains in a turn-off state, and the emission device stops emitting light.

2. The display device of claim 1, wherein the fake image is a black image or a low-grayscale image.

3. The display device of claim 1, wherein a voltage of the first node of the driving transistor is higher than a voltage of the second node of the driving transistor in each subpixel included in the subpixel line on which the first driving is performed, and wherein a voltage of the first node of the driving transistor is lower than a voltage of the second node of the driving transistor in each subpixel included in the subpixel line on which the second driving is performed.

4. The display device of claim 1, wherein the first reference voltage is higher than the image data voltage applied to the second node of the driving transistor.

5. The display device of claim 1, wherein the second reference voltage is lower than the boosted voltage of the second node of the driving transistor when emission is performed.

6. The display device of claim 1, wherein while a first subpixel line of the plurality of subpixel lines performs the data program during the first driving, a subpixel line different from the first subpixel line performs the second driving, and wherein while a second subpixel line of the plurality of subpixel lines performs the second driving, a subpixel line different from the second subpixel line performs the data program during the first driving.

7. The display device of claim 1, wherein while the first reference voltage is applied to a plurality of subpixels included in a first subpixel line of the plurality of subpixel lines, the second reference voltage is applied to a plurality of subpixels included in a subpixel line different from the first subpixel line, and wherein while the second reference voltage is applied to a plurality of subpixels included in a second subpixel line of the plurality of subpixel lines, the first reference voltage is applied to a plurality of subpixels included in a subpixel line different from the second subpixel line.

8. The display device of claim 1, wherein the first reference voltage and the second reference voltage are equal.

9. The display device of claim 1, wherein the second reference voltage is lower than the first reference voltage.

10. The display device of claim 1, wherein the plurality of reference lines are arranged in parallel to the plurality of data lines and each reference line is arranged for every one or more subpixel columns, and wherein a reference voltage supplied to the plurality of reference lines is variable in the data driving circuit or a printed circuit board.

11. The display device of claim 1, wherein the plurality of reference lines are arranged in parallel to the plurality of first or second gate lines, wherein all of the plurality of reference lines are electrically connected to one outer wire arranged in a non-active area, and wherein a reference voltage supplied to the one outer wire is variable in the data driving circuit or a printed circuit board.

12. The display device of claim 1, wherein the plurality of reference lines are arranged in parallel to the plurality of first or second gate lines, wherein the plurality of reference lines are grouped into two or more groups and electrically connected to two or more outer wires arranged in a non-active area, and wherein a reference voltage supplied to each of the two or more outer wires is variable in the data driving circuit or a printed circuit board.

13. The display device of claim 1, wherein a capacitance of a capacitor component of the emission device is greater than a capacitance of the storage capacitor.

14. The display device of claim 1, wherein the data driving circuit comprises K digital-to-analog converters corresponding to K data lines, and one analog-to-digital converter corresponding to K data lines, where K is a positive number, and wherein one of the K data lines is electrically connected to one of the K digital-to-analog converters or is connected to the analog-to-digital converter.

15. The display device of claim 1, wherein the data driving circuit comprises K digital-to-analog converters and K analog-to-digital converters corresponding to K data lines, where K is a positive number, and wherein one of the K data lines is electrically connected to one of the K digital-to-analog converters or is connected to one of the K analog-to-digital converters.

* * * * *